US006686111B1

(12) United States Patent
Moffat et al.

(10) Patent No.: US 6,686,111 B1
(45) **Date of Patent: *Feb. 3, 2004**

(54) TONER COMPOSITIONS COMPRISING VINYL RESIN AND POLY (3,4-ETHYLENEDIOXYTHIOPHENE)

(75) Inventors: Karen A. Moffat, Brantford (CA); Maria N. V. McDougall, Burlington (CA); Rina Carlini, Mississauga (CA); Dan A. Hays, Fairport, NY (US); Jack T. LeStrange, Macedon, NY (US); Paul J. Gerroir, Oakville (CA)

(73) Assignee: Xerox Corporation, Stamford, CT (US)

( * ) Notice: Subject to any disclaimer, the term of this patent is extended or adjusted under 35 U.S.C. 154(b) by 68 days.

This patent is subject to a terminal disclaimer.

(21) Appl. No.: 09/724,013

(22) Filed: Nov. 28, 2000

(51) Int. Cl.[7] ..... G03G 9/097

(52) U.S. Cl. ..... 430/108.5; 430/109.3; 430/110.2; 430/137.11; 430/137.14

(58) Field of Search ..... 430/108.5, 110.2, 430/109.3, 137.14, 137.12, 137.19, 137.2, 110, 137.11

(56) References Cited

U.S. PATENT DOCUMENTS

| | | | | |
|---|---|---|---|---|
| 4,299,898 A | | 11/1981 | Williams et al. | |
| 5,035,926 A | | 7/1991 | Jonas et al. | 427/393.1 |
| 5,202,211 A | | 4/1993 | Vercoulen et al. | 430/108.6 |
| 5,348,832 A | | 9/1994 | Sacripante et al. | 430/109.4 |
| 5,403,693 A | * | 4/1995 | Patel et al. | 430/137.14 |
| 5,424,160 A | | 6/1995 | Smith et al. | |
| 5,457,001 A | | 10/1995 | Van Ritter | 430/108.22 |
| 5,766,817 A | | 6/1998 | Cheng et al. | |
| 5,834,080 A | | 11/1998 | Mort et al. | 428/36.91 |
| 5,853,906 A | | 12/1998 | Hsieh | 428/690 |
| 5,962,178 A | * | 10/1999 | Cheng | 523/335 |
| 6,013,404 A | * | 1/2000 | Feng et al. | 430/126 |
| 6,025,104 A | | 2/2000 | Fuller et al. | |

FOREIGN PATENT DOCUMENTS

| | | |
|---|---|---|
| EP | 0 339 340 A2 | 4/1989 |
| EP | 0 440 957 A2 | 12/1990 |
| EP | 0636943 A1 * | 2/1995 |
| EP | 1 134 620 | 9/2001 |
| EP | 1 209 531 | 5/2002 |
| EP | 1 209 533 | 5/2002 |
| JP | 61-141452 | 6/1986 |
| JP | 62-264066 | 11/1987 |
| JP | 3-86763 | 4/1991 |
| JP | 3-100561 | 4/1991 |

OTHER PUBLICATIONS

Patent Abstracts of Japan English–Language Abstract Describing Japanese Patent 03–086763 (pub 4/91)., Apr. 1991.*

Patent Abstracts of Japan English–Language Abstract Describing Japanese Patent 62–264066(pub 11/87), Nov. 1987.*

U S Patent & Trademark English–Language Translation of Research Disclosure, No. 37349, No. 373, May 1995, pp 356–357.*

Diamond, A. S., ed. *Handbook of Imaging Materials*, Marcel Dekker, Inc, NY (1991), pp 165–169, 1991.*

*Research Disclosure*, No. 37349, No. 373, May 1995, Kenneth Mason Publications, Ltd., England, p 356.*

Derwent Abstract, Section Ch, Week 199433 describing JP 06196309.

Caplus Abstract Acc No. 1992:13303 describing JP 3–100561.

Japanese Patent Office Abstract describing JP 3–100561.

Caplus Abstract Acc. No. 1986:616683 describing JP 61–141452.

* cited by examiner

*Primary Examiner*—Janis L. Dote
(74) *Attorney, Agent, or Firm*—Judith L. Byorick

(57) ABSTRACT

Disclosed is a toner comprising particles of a vinyl resin, an optional colorant, and poly(3,4-ethylenedioxythiophene), wherein said toner particles are prepared by an emulsion aggregation process. Another embodiment of the present invention is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process.

40 Claims, 4 Drawing Sheets

FIG. 3
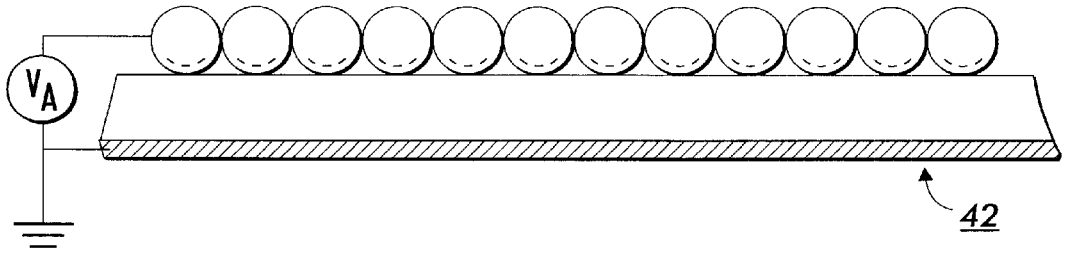
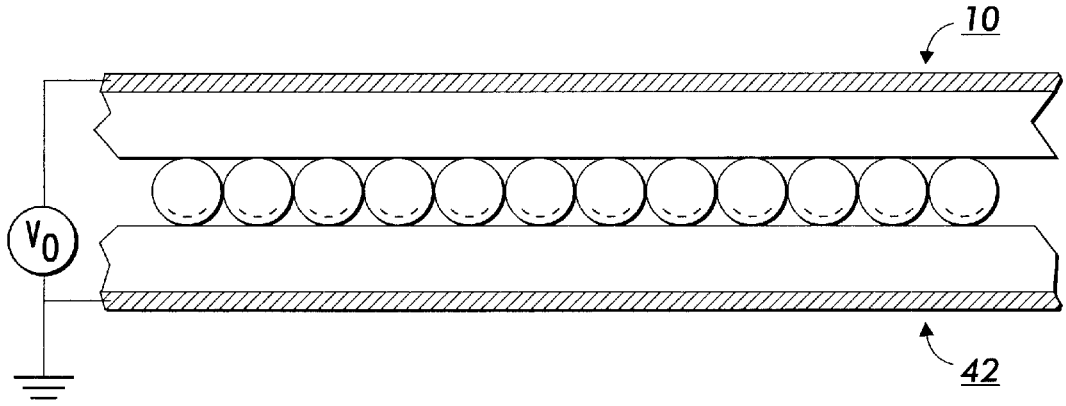
FIG. 4

TONER COMPOSITIONS COMPRISING VINYL RESIN AND POLY (3,4-ETHYLENEDIOXYTHIOPHENE)

CROSS REFERENCE TO RELATED APPLICATIONS

Application U.S. Ser. No. 09/723,778, now U.S. Pat. No. 6,383,561 B1, filed concurrently herewith, entitled "Ballistic Aerosol Marking Process Employing Marking Material Comprising Vinyl Resin and Poly(3,4-ethylenedioxythiophene)," with the named inventors Karen A. Moffat and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/723,577, now U.S. Pat. No. 6,503,678 B1, filed concurrently herewith, entitled "Ballistic Aerosol Marking Process Employing Marking Material Comprising Vinyl Resin and Poly(3,4-ethylenedioxypyrrole)," with the named inventors Karen A. Moffat, Rina Carlini, Maria N. V. McDougall, and Paul J. Gerroir, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/724,458 now U.S. Pat. No. 6,503,678 B1, filed concurrently herewith, entitled "Toner Compositions Comprising Polythiophenes," with the named inventors Karen A. Moffat, Maria N. V. McDougall, Rina Carlini, Dan A. Hays, Jack T. LeStrange, and Paul J. Gerroir, the disclosure of which is totally incorporated herein by reference, discloses a toner comprising particles of a resin and an optional colorant, said toner particles having coated thereon a polythiophene. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polythiophene.

Application U.S. Ser. No. 09/723,839 now U.S. Pat. No. 6,492,082 B1, filed concurrently herewith, entitled "Toner Compositions Comprising Polypyrroles," with the named inventors Karen A. Moffat, Maria N. V. McDougall, Rina Carlini, Dan A. Hays, Jack T. LeStrange, and James R. Combes, the disclosure of which is totally incorporated herein by reference, discloses a toner comprising particles of a resin and an optional colorant, said toner particles having coated thereon a polypyrrole. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polypyrrole.

Application U.S. Ser. No. 09/723,787, now U.S. Pat. No. 6,439,711 B1, filed concurrently herewith, entitled "Ballistic Aerosol Marking Process Employing Marking Material Comprising Polyester Resin and Poly(3,4-ethylenedioxythiophene)," with the named inventors Rina Carlini, Karen A. Moffat, Maria N. V. McDougall, and Danielle C. Boils, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/723,834, now U.S. Pat. No. 6,387,442 B1, filed concurrently herewith, entitled "Ballistic Aerosol Marking Process Employing Marking Material Comprising Polyester Resin and Poly(3,4-ethylenedioxypyrrole)," with the named inventors Karen A. Moffat, Rina Carlini, and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Application U.S. Ser. No. 09/724,064, filed concurrently herewith, entitled "Toner Compositions Comprising Polyester Resin and Poly(3,4-ethylenedioxythiophene)," with the named inventors Karen A. Moffat, Rina Carlini, Maria N. V. McDougall, Dan A. Hays, and Jack T. LeStrange, the disclosure of which is totally incorporated herein by reference, discloses a toner comprising particles of a polyester resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxythiophene), wherein said toner particles are prepared by an emulsion aggregation process.

Application U.S. Ser. No. 09/723,851 now U.S. Pat. No. 6,485,874 B1, filed concurrently herewith, entitled "Toner Compositions Comprising Vinyl Resin and Poly(3,4-ethylenedioxypyrrole)," with the named inventors Karen A. Moffat, Maria N. V. McDougall, Rina Carlini, Dan A. Hays, Jack T. LeStrange, and Paul J. Gerroir, the disclosure of which is totally incorporated herein by reference, discloses a toner comprising particles of a vinyl resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the, latent image by contacting the imaging member with charged toner particles comprising a vinyl resin, an optional colorant, and poly(3,4-ethylenedioxypyrrole), wherein said toner particles are prepared by an emulsion aggregation process.

Application U.S. Ser. No. 09/723,907, now U.S. 6,387,581 B1, filed concurrently herewith, entitled "Toner Compositions Comprising Polyester Resin and Poly(3,4-ethylenedioxypyrrole)," with the named inventors Karen A. Moffat, Rina Carlini, Maria N. V. McDougall, Dan A. Hays, and Jack T. LeStrange, the disclosure of which is totally incorporated herein by reference, discloses a toner comprising particles of a polyester resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxypyrrole), wherein said toner particles are prepared by an emulsion aggregation process.

Application U.S. Ser. No. 09/723,654, now U.S. Pat. No. 6,365,318 B1, filed concurrently herewith, entitled "Process for Controlling Triboelectric Charging," with the named inventors Karen A. Moffat, Maria N. V. McDougall, and James R. Combes, the disclosure of which is totally incorporated herein by reference, discloses a process which comprises; (a) dispersing into a solvent (i) toner particles comprising a resin and an optional colorant, and (ii) monomers selected from pyrroles, thiophenes, or mixtures thereof; and (b) causing, by exposure of the monomers to an oxidant, oxidative polymerization of the monomers onto the toner particles, wherein subsequent to polymerization, the toner particles are capable of being charged to a negative or positive polarity, and wherein the polarity is determined by the oxidant selected.

Application U.S. Ser. No. 09/723,911, filed concurrently herewith, entitled "Toner Compositions Comprising Polyester Resin and Polypyrrole," with the named inventors James R. Combes, Karen A. Moffat, and Maria N. V. McDougall, the disclosure of which is totally incorporated herein by reference, discloses a toner comprising particles of a polyester resin, an optional colorant, and polypyrrole, wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and polypyrrole, wherein said toner particles are prepared by an emulsion aggregation process.

Application U.S. Ser. No. 09/723,561, now U.S. 6,360,067 B1, filed concurrently herewith, entitled "Electrophotographic Development System With Induction Charged Toner," with the named inventors Dan A. Hays and Jack T. LeStrange, the disclosure of which is totally incorporated herein by reference, discloses an apparatus for developing a latent image recorded on an imaging surface, including a housing defining a reservoir storing, a supply of developer material comprising conductive toner; a donor member for transporting toner on an outer surface of said donor member to a region in synchronous contact with the imaging surface, means for loading a toner layer onto a region of said outer surface of said donor member; means for induction charging said toner loaded on said donor member; means for conditioning toner layer; means for moving said donor member in synchronous contact with imaging member to detach toner from said region of said donor member for developing the latent image; and means for discharging and removing residual toner from said donor and returning said toner to the reservoir.

Application U.S. Ser. No. 09/723,934, now U.S. Pat. No. 6,353,723 B1, filed concurrently herewith, entitled "Electrophotographic Development System With Induction Charged Toner," with the named inventors Dan A. Hays and Jack T. LeStrange, the disclosure of which is totally incorporated herein by reference, discloses a method of developing a latent image recorded or an image receiving member with marking particles, to form a developed image, including the steps of moving the surface of the image receiving member at a predetermined process speed; storing a supply of developer material comprising conductive toner in a reservoir; transporting developer material on a donor member to a development zone adjacent the image receiving member; and; inductive charging said toner layer onto said outer surface of said donor member prior to the development zone to a predefined charge level.

Application U.S. Ser. No. 09/723,789, now U.S. Pat. No. 6,463,239 B1, filed concurrently herewith, entitled "Electrophotographic Development System With Custom Color Printing," with the named inventors Dan A. Hays and Jack T. LeStrange, the disclosure of which is totally incorporated herein by reference, discloses an apparatus for developing a latent image recorded on an imaging surface, including: a first developer unit for developing a portion of said latent image with a toner of custom color, said first developer including a housing defining a reservoir for storing a supply of developer material comprising conductive toner; a dispenser for dispensing toner of a first color and toner of a second color into said housing, said dispenser including means for mixing toner of said first color and toner of said second color together to form toner of said custom color; a donor member for transporting toner of said custom color on an outer surface of said donor member to a development zone; means for loading a toner layer of said custom color onto said outer surface of said donor member; and means for inductive charging said toner layer onto said outer surface of said donor member prior to the development zone to a predefine charge level; and a second developer unit for developing a remaining portion of said latent image with toner being substantial different than said toner of said custom color.

BACKGROUND OF THE INVENTION

The present invention is directed to toners suitable for use in electrostatic imaging processes. More specifically, the present invention is directed to toner compositions that can be used in processes such as electrography, electrophotography, ionography, or the like, including processes wherein the toner particles are triboelectrically charged and processes wherein the toner particles are charged by a nonmagnetic inductive charging process. One embodiment of the present invention is directed to a toner comprising particles of a vinyl resin, an optional colorant, and poly(3,4-ethylenedioxythiophene), wherein said toner particles are prepared by an emulsion aggregation process. Another embodiment of the present invention is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Another known process for forming electrostatic images is ionography. In ionographic imaging processes, a latent image is formed on a dielectric image receptor or electroreceptor by ion or electron deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic or electron beam writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Powder development systems normally fall into two classes: two component, in which the developer material comprises magnetic carrier granules having toner particles adhering triboelectrically thereto, and single component, which typically uses toner only. Toner particles are attracted to the latent image, forming a toner powder image. The operating latitude of a powder xerographic development system is determined to a great degree by the ease with which toner particles are supplied to an electrostatic image. Placing charge on the particles, to enable movement and imagewise development via electric fields, is most often accomplished with triboelectricity.

The electrostatic image in electrophotographic copying/printing systems is typically developed with a nonmagnetic, insulative toner that is charged by the phenomenon of triboelectricity. The triboelectric charging is obtained either by mixing the toner with larger carrier beads in a two component development system or by rubbing the toner between a blade and donor roll in a single component system.

Triboelectricity is often not well understood and is often unpredictable because of a strong materials sensitivity. For example, the materials sensitivity causes difficulties in identifying a triboelectrically compatible set of color toners that can be blended for custom colors. Furthermore, to enable "offset" print quality with powder-based electrophotographic development systems, small toner particles (about 5 micron diameter) are desired. Although the functionality of small, triboelectrically charged toner has been demonstrated, concerns remain regarding the long-term stability and reliability of such systems.

In addition, development systems which use triboelectricity to charge toner, whether they be two component (toner and carrier) or single component (toner only), tend to exhibit nonuniform distribution of charges on the surfaces of the toner particles. This nonuniform charge distribution results in high electrostatic adhesion because of localized high surface charge densities on the particles. Toner adhesion, especially in the development step, can limit performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, triboelectric charged particles much more difficult to develop and control.

To circumvent limitations associated with development systems based on triboelectrically charged toner, a non-tribo toner charging system can be desirable to enable a more stable development system with greater toner materials latitude. Conventional single component development (SCD) systems based on induction charging employ a magnetic loaded toner to suppress background deposition. If with such SCD systems one attempts to suppress background deposition by using an electric field of polarity opposite to that of the image electric field (as practiced with electrophotographic systems that use a triboelectric toner charging development system), toner of opposite polarity to the image toner will be induction charged and deposited in the background regions. To circumvent this problem, the electric field in the background regions is generally set to near zero. To prevent deposition of uncharged toner in the background regions, a magnetic material is included in the toner so that a magnetic force can be applied by the incorporation of magnets inside the development roll. This type of SCD system is frequently employed in printing apparatus that also include a transfuse process, since conductive (black) toner may not be efficiently transferred to paper with an electrostatic force if the relative humidity is high. Some printing apparatus that use an electron beam to form an electrostatic image on an electroreceptor also use a SCD system with conductive, magnetic (black) toner. For these apparatus, the toner is fixed to the paper with a cold high-pressure system. Unfortunately, the magnetic material in the toner for these printing systems precludes bright colors.

Powder-based toning systems are desirable because they circumvent a need to manage and dispose of liquid vehicles used in several printing technologies including offset, thermal ink jet, liquid ink development, and the like. Although phase change inks do not have the liquid management and disposal issue, the preference that the ink have a sharp viscosity dependence on temperature can compromise the mechanical properties of the ink binder material when compared to heat/pressure fused powder toner images.

To achieve a document appearance comparable to that obtainable with offset printing, thin images are desired. Thin images can be achieved with a monolayer of small (about 5 micron) toner particles. With this toner particle size, images of desirable thinness can best be obtained with monolayer to sub-monolayer toner coverage. For low micro-noise images with sub-monolayer coverage, the toner preferably is in a nearly ordered array on a microscopic scale.

To date, no magnetic material has been formulated that does not have at least some unwanted light absorption. Consequently, a nonmagnetic toner is desirable to achieve the best color gamut in color imaging applications.

For a printing process using an induction toner charging mechanism, the toner should have a certain degree of conductivity. Induction charged conductive toner, however, can be difficult to transfer efficiently to paper by an electrostatic force if the relative humidity is high. Accordingly, it is generally preferred for the toner to be rheologically transferred to the (heated) paper.

A marking process that enables high-speed printing also has considerable value.

Electrically conductive toner particles are also useful in imaging processes such as those described in, for example, U.S. Pat. Nos. 3,639,245, 3,563,734, European Patent 0,441,426, French Patent 1,456,993, and United Kingdom Patent 1,406,983, the disclosures of each of which are totally incorporated herein by reference.

U.S. Pat. No. 5,834,080 (Mort et al.), the disclosure of which is totally incorporated herein by reference, discloses controllably conductive polymer compositions that may be used in electrophotographic imaging developing systems, such as scavengeless or hybrid scavengeless systems or liquid image development systems. The conductive polymer compositions includes a charge-transporting material (particularly a charge-transporting, thiophene-containing polymer or an inert elastomeric polymer, such as a butadiene- or isoprene-based copolymer or an aromatic polyether-based polyurethane elastomer, that additionally comprises charge transport molecules) and a dopant capable of accepting electrons from the charge-transporting material. The invention also relates to an electrophotographic printing machine, a developing apparatus, and a coated transport member, an intermediate transfer belt, and a hybrid compliant photoreceptor comprising a composition of the invention.

U.S. Pat. No. 5,853,906 (Hsieh), the disclosure of which is totally incorporated herein by reference, discloses a conductive coating comprising an oxidized oligomer salt, a charge transport component, and a polymer binder, for example, a conductive coating comprising an oxidized tetratolyidiamine salt of the formula

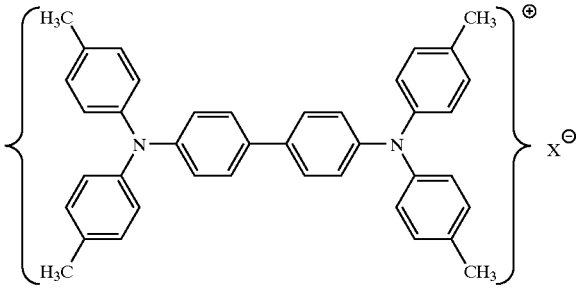

a charge transport component, and a polymer binder, wherein X− is a monovalent anion.

U.S. Pat. No. 5,457,001 (Van Ritter), the disclosure of which is totally incorporated herein by reference, discloses an electrically conductive toner powder, the separate particles of which contain thermoplastic resin, additives conventional in toner powders, such as coloring constituents and possibly magnetically attractable material, and an electrically conductive protonized polyaniline complex, the protonized polyaniline complex preferably having an electrical conductivity of at least 1 S/cm, the conductive complex being distributed over the volume of the toner particles or present in a polymer-matrix at the surface of the toner particles.

U.S. Pat. No. 5,202,211 (Vercoulen et al.), the disclosure of which is totally incorporated herein by reference, discloses a toner powder comprising toner particles which carry on their surface and/or in an edge zone close to the surface fine particles of electrically conductive material consisting of fluorine-doped tin oxide. The fluorine-doped tin oxide particles have a primary particle size of less than 0.2 micron and a specific electrical resistance of at most 50 ohms.meter. The fluorine content of the tin oxide is less than 10 percent by weight, and preferably is from 1 to 5 percent by weight.

U.S. Pat. No. 5,035,926 (Jonas et al.), the disclosure of which is totally incorporated herein by reference, discloses new polythiophenes containing structural units of the formula

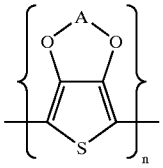

in which A denotes an optionally substituted $C_1$–$C_4$ alkylene radical, their preparation by oxidative polymerization of the corresponding thiophenes, and the use of the polythiophenes for imparting antistatic properties on substrates which only conduct electrical current poorly or not at all, in particular on plastic mouldings, and as electrode material for rechargeable batteries.

While known compositions and processes are suitable for their intended purposes, a need remains for improved marking processes. In addition, a need remains for improved electrostatic imaging processes. Further, a need remains for toners that can be charged inductively and used to develop electrostatic latent images. Additionally, a need remains for toners that can be used to develop electrostatic latent images without the need for triboelectric charging of the toner with a carrier. There is also a need for toners that are sufficiently conductive to be employed in an inductive charging process without being magnetic. In addition, there is a need for conductive, nonmagnetic toners that enable controlled, stable, and predictable inductive charging. Further, there is a need for conductive, nonmagnetic, inductively chargeable toners that are available in a wide variety of colors. Additionally, there is a need for conductive, nonmagnetic, inductively chargeable toners that enable uniform development of electrostatic images. A need also remains for conductive, nonmagnetic, inductively chargeable toners that enable development of high quality full color and custom or highlight color images. In addition, a need remains for conductive, nonmagnetic, inductively chargeable toners that enable generation of transparent, light-transmissive color images. Further, a need remains for conductive, nonmagnetic, inductively chargeable toners that have relatively small average particle diameters (such as 10 microns or less). Additionally, a need remains for conductive, nonmagnetic, inductively chargeable toners that have relatively uniform size and narrow particle size distribution values. There is also a need for toners suitable for use in printing apparatus that employ electron beam imaging processes. In addition, there is a need for toners suitable for use in printing apparatus that employ single component development imaging processes. Further, there is a need for conductive, nonmagnetic, inductively chargeable toners with desirably low melting temperatures. Additionally, there is a need for conductive, nonmagnetic, inductively chargeable toners with tunable gloss properties, wherein the same monomers can be used to generate toners that have different melt and gloss characteristics by varying polymer characteristics such as molecular weight ($M_w$, $M_n$, $M_{WD}$, or the like) or crosslinking. There is also a need for conductive, nonmagnetic, inductively chargeable toners that can be prepared by relatively simple and inexpensive methods. In addition, there is a need for conductive, nonmagnetic, inductively chargeable toners with desirable glass transition temperatures for enabling efficient transfer of the toner from an intermediate transfer or transfuse member to a print substrate. Further, there is a need for conductive, nonmagnetic, inductively chargeable toners with desirable glass transition temperatures for enabling efficient transfer of the toner from a heated intermediate transfer or transfuse member to a print substrate. Additionally, there is a need for conductive, nonmagnetic, inductively chargeable toners that exhibit good fusing performance. A need also remains for conductive, nonmagnetic, inductively chargeable toners that form images with low toner pile heights, even for full color superimposed images. In addition, a need remains for conductive, nonmagnetic, inductively chargeable toners wherein the toner comprises a resin particle encapsulated with a conductive polymer, wherein the conductive polymer is chemically bound to the particle surface. Further, a need remains for conductive, nonmagnetic, inductively chargeable toners that comprise particles having tunable morphology in that the particle shape can be selected to be spherical, highly irregular, or the like. Additionally, a need remains for insulative, triboelectrically chargeable toners that are available in a wide variety of colors. There is also a need for insulative, triboelectrically chargeable toners that enable uniform development of electrostatic images. In addition, there is a need for insulative, triboelectrically chargeable toners that enable development of high quality full color and custom or highlight color images. Further, there is a need for insulative, triboelectrically chargeable toners that enable generation of transparent, light-transmissive color images. Additionally, there is a need for insulative, triboelectrically chargeable toners that have relatively small average particle diameters (such as 10 microns or less). A need also remains for insulative, triboelectrically chargeable toners that have relatively uniform size and narrow particle size distribution values. In addition, a need remains for insulative, triboelectrically chargeable toners with desirably low melting temperatures. Further, a need remains for insulative, triboelectrically chargeable toners with tunable gloss properties, wherein the same monomers can be used to generate toners that have different melt and gloss characteristics by varying polymer characteristics such as molecular weight ($M_w$, $M_n$, $M_{WD}$, or the like) or crosslinking. Additionally, a need remains for insulative, triboelectrically chargeable toners that can be prepared by relatively simple and inexpensive methods. There is also a need for insulative, triboelectrically chargeable toners with desirable glass transition temperatures for enabling efficient transfer of the toner from an intermediate transfer or transfuse member to a print substrate. In addition, there is a need for insulative, triboelectrically chargeable toners with desirable glass transition temperatures for enabling efficient transfer of the toner from a heated intermediate transfer or transfuse member to a print substrate. Further, there is a need for insulative, triboelectrically chargeable toners that exhibit good fusing performance. Additionally, there is a need for insulative, triboelectrically chargeable toners that form images with low toner pile heights, even for full color superimposed images. A need also remains for insulative, triboelectrically chargeable toners wherein the toner comprises a resin particle encapsulated with a polymer, wherein the polymer is chemically bound to the particle surface. In addition, a need remains for insulative, triboelectrically chargeable toners that comprise particles having tunable morphology in that the particle shape can be selected to be spherical, highly irregular, or the like. Further, a need remains for insulative, triboelectrically chargeable toners that can be made to charge either positively or negatively, as desired, without varying the resin or colorant comprising the toner particles. Additionally, a need remains for insulative, triboelectrically chargeable toners that can be made to charge either positively or negatively, as desired, without the need to use or vary surface additives. There is also a need for both conductive, inductively chargeable toners and insulative, triboelectrically chargeable toners that enable production of toners of different colors that can reach the same equilibrium levels of charge, and that enable modification of toner color without affecting the charge of the toner; the sets of different colored toners thus prepared enable generation of high quality and uniform color images in color imaging processes.

SUMMARY OF THE INVENTION

The present invention is directed to a toner comprising particles of a vinyl resin, an optional colorant, and poly(3,4-ethylenedioxythiophene), wherein said toner particles are prepared by an emulsion aggregation process. Another embodiment of the present invention is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process.

BRIEF DESCRIPTION OF THE DRAWINGS

FIG. 3 illustrates a monolayer of induction charged toner on a dielectric overcoated substrate.

FIG. 4 illustrates a monolayer of previously induction charged toner between donor and receiver dielectric overcoated substrates.

DETAILED DESCRIPTION OF THE INVENTION

Figure 1:
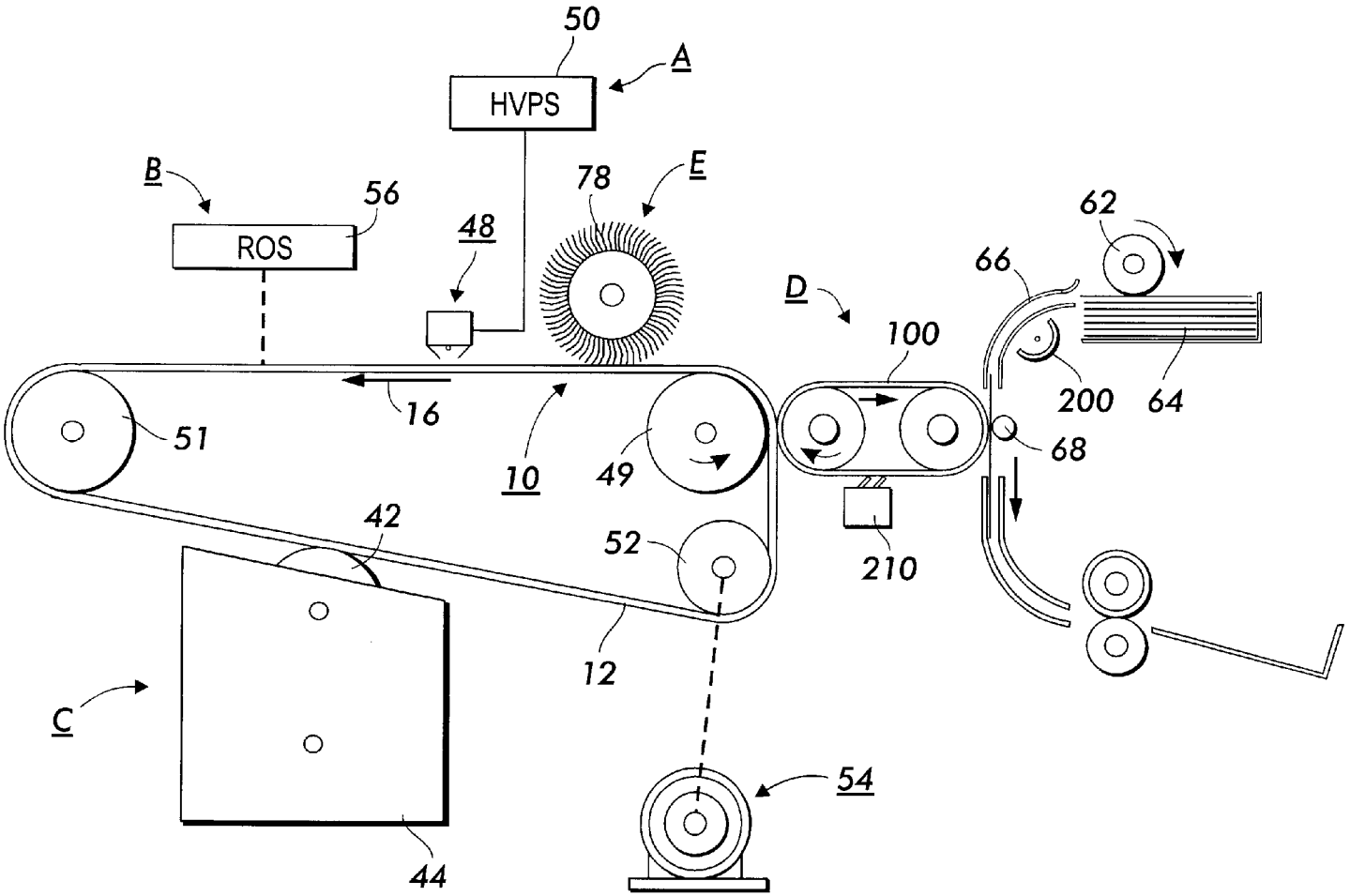
FIG. 1 is a schematic elevational view of an illustrative electrophotographic printing machine suitable for use with the present invention.

Toners of the present invention can be used in conventional electrostatic imaging processes, such as electrophotography, ionography, electrography, or the like. In some embodiments of these processes, the toner can comprise particles that are relatively insulative for use with triboelectric charging processes, with average bulk conductivity values typically of no more than about $10^{-12}$ Siemens per centimeter, and preferably no more than about $10^{-13}$ Siemens per centimeter, and with conductivity values typically no less than about $10^{-16}$ Siemens per centimeter, and preferably no less than about $10^{-15}$ Siemens per centimeter, although the conductivity values can be outside of these ranges. "Average bulk conductivity" refers to the ability for electrical charge to pass through a pellet of the particles, measured when the pellet is placed between two electrodes. The particle conductivity can be adjusted by various synthetic parameters of the polymerization; reaction time, molar ratios of oxidant and dopant to 3,4-ethylenedioxythiophene monomer, temperature, and the like. These insulative toner particles are charged triboelectrically and used to develop the electrostatic latent image.

In embodiments of the present invention in which the toners are used in electrostatic imaging processes wherein the toner particles are triboelectrically charged, toners of the present invention can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 30 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. Nos. 3,526,533, 3,849,186, and 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

In a two-component developer, the toner is present in the developer in any effective amount, typically from about 1 to about 10 percent by weight of the carrier, and preferably from about 3 to about 6 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, and the like. Magnetic brush development is more fully described, for example, in U.S. Pat. No. 2,791,949, the disclosure of which is totally incorporated herein by reference; cascade development is more fully described, for example, in U.S. Pat. Nos. 2,618,551 and 2,618,552, the disclosures of each of which are totally incorporated herein by reference; powder cloud development is more fully described, for example, in U.S. Pat. Nos. 2,725,305, 2,918,910, and 3,015,305, the disclosures of each of which are totally incorporated herein by reference.

In other embodiments of the present invention wherein nonmagnetic inductive charging methods are employed, the toners can comprise particles that are relatively conductive, with average bulk conductivity values typically of no less than about $10^{-11}$ Siemens per centimeter, and preferably no less than about $10^{-7}$ Siemens per centimeter, although the conductivity values can be outside of these ranges. There is no upper limit on conductivity for these embodiments of the present invention. "Average bulk conductivity" refers to the ability for electrical charge to pass through a pellet of the particles, measured when the pellet is placed between two electrodes. The particle conductivity can be adjusted by various synthetic parameters of the polymerization; reaction time, molar ratios of oxidant and dopant to 3,14-ethylenedioxythiophene monomer, temperature, and the like. These conductive toner particles are charged by a nonmagnetic inductive charging process and used to develop the electrostatic latent image.

While the present invention will be described in connection with a specific embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the printing machine of FIG. 1 will be shown hereinafter schematically and their operation described briefly with reference thereto.

Referring initially to FIG. 1, there is shown an illustrative electrostatographic printing machine. The printing machine, in the shown embodiment an electrophotographic printer (although other printers are also suitable, such as ionographic printers and the like), incorporates a photoreceptor 10, in the shown embodiment in the form of a belt (although other known configurations are also suitable, such as a roll, a drum, a sheet, or the like), having a photoconductive surface layer 12 deposited on a substrate. The substrate can be made from, for example, a polyester film such as MYLAR® that has been coated with a thin conductive layer which is electrically grounded. The belt is driven by means of motor 54 along a path defined by rollers 49, 51, and 52, the direction of movement being counterclockwise as viewed and as shown by arrow 16. Initially a portion of the belt 10 passes through a charge station A at which a corona generator 48 charges surface 12 to a relatively high, substantially uniform, potential. A high voltage power supply 50 is coupled to device 48.

Next, the charged portion of photoconductive surface 12 is advanced through exposure station B. In the illustrated embodiment, at exposure station B, a Raster Output Scanner (ROS) 56 scans the photoconductive surface in a series of scan lines perpendicular to the process direction. Each scan line has a specified number of pixels per inch. The ROS includes a laser with a rotating polygon mirror to provide the scanning perpendicular to the process direction. The ROS imagewise exposes the charged photoconductive surface 12. Other methods of exposure are also suitable, such as light lens exposure of an original document or the like.

After the electrostatic latent image has been recorded on photoconductive surface 12, belt 10 advances the latent electrostatic image to development station C as shown in FIG. 1. At development station C, a development system or developer unit 44 develops the latent image recorded on the photoconductive surface. The chamber in the developer housing stores a supply of developer material. In embodiments of the present invention in which the developer material comprises insulative toner particles that are triboelectrically charged, either two component development, in which the developer comprises toner particles and carrier particles, or single component development, in which only toner particles are used, can be selected for developer unit 44. In embodiments of the present invention in which the developer material comprises conductive or semiconductive toner particles that are inductively charged, the developer material is a single component developer consisting of nonmagnetic, conductive toner that is induction charged on a dielectric overcoated donor roll prior to the development zone. The developer material may be a custom color consisting of two or more different colored dry powder toners.

Again referring to FIG. 1, after the electrostatic latent image has been developed, belt 10 advances the developed image to transfer station D. Transfer can be directly from the imaging member to a receiving sheet or substrate, such as paper, transparency, or the like, or can be from the imaging member to an intermediate and subsequently from the intermediate to the receiving sheet or substrate. In the illustrated embodiment, at transfer station D, the developed image 4 is tack transferred to a heated transfuse belt or roll 100. The covering on the compliant belt or drum typically consists of a thick (1.3 millimeter) soft (IRHD hardness of about 40) silicone rubber. (Thinner and harder rubbers provide tradeoffs in latitudes. The rubber can also have a thin VITON® top coat for improved reliability.) If the transfuse belt or roll is maintained at a temperature near 120° C., tack transfer of the toner from the photoreceptor to the transfuse belt or drum can be obtained with a nip pressure of about 50 pounds per square inch. As the toned image advances from the photoreceptor-transfuse belt nip to the transfuse belt-medium transfuse nip formed between transfuse belt 100 and roller 68, the toner is softened by the ~120° C. transfuse belt temperature. With the receiving sheet 64 preheated to about 85° C. in guides 66 by a heater 200, as receiving sheet 64 is advanced by roll 62 and guides 66 into contact with the developed image on roll 100, transfuse of the image to the receiving sheet is obtained with a nip pressure of about 100 pounds per square inch. It should be noted that the toner release from the roll 100 can be aided by a small amount of silicone oil that is imbibed in the roll for toner release at the toner/roll interface. The bulk of the compliant silicone material also contains a conductive carbon black to dissipate any charge accumulation. As noted in FIG. 1, a cleaner 210 for the transfuse belt material is provided to remove residual toner and fiber debris. An optional glossing station (not shown) can be employed by the customer to select a desired image gloss level.

After the developed image has been transferred from photoconductive surface 12 of belt 10, the residual developer material adhering to photoconductive surface 12 is removed therefrom by a rotating fibrous brush 78 at cleaning station E in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

Figure 2:
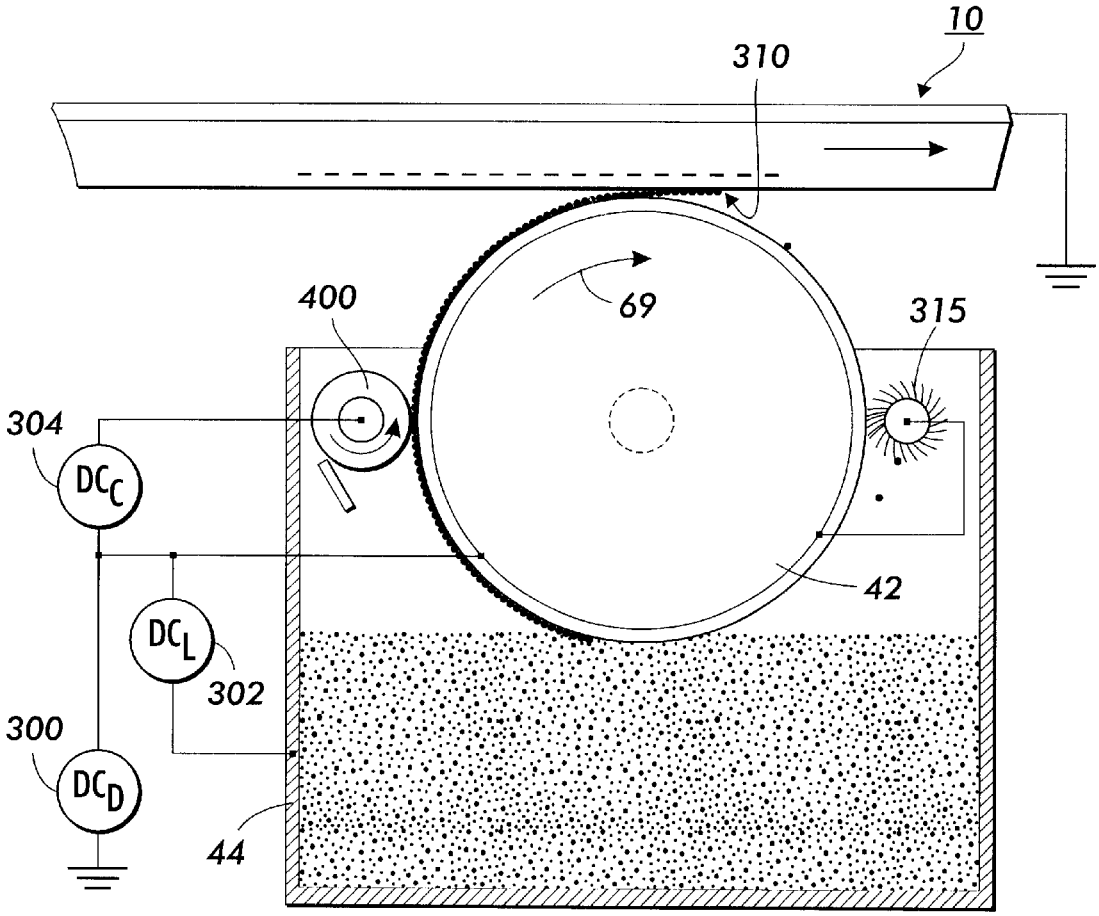
FIG. 2 is a schematic illustration of a development system suitable for use with the present invention.

Referring now to FIG. 2, which illustrates a specific embodiment of the present invention in which the toner in housing 44 is inductively charged, as the donor 42 rotates in the direction of arrow 69, a voltage $DC_D$ 300 is applied to the donor roll to transfer electrostatically the desired polarity of toner to the belt 10 while at the same time preventing toner transfer in the nonimage areas of the imaged belt 10. Donor roll 42 is mounted, at least partially, in the chamber of developer housing 44 containing nonmagnetic conductive toner. The chamber in developer housing 44 stores a supply of the toner that is in contact with donor roll 42. Donor roll 42 can be, for example, a conductive aluminum core overcoated with a thin (50 micron) dielectric insulating layer. A voltage $DC_L$ 302 applied between the developer housing 44 and the donor roll 42 causes induction charging and loading of the nonmagnetic conductive toner onto the dielectric overcoated donor roll.

As successive electrostatic latent images are developed, the toner particles within the developer housing 44 are depleted. A toner dispenser (not shown) stores a supply of toner particles. The toner dispenser is in communication with housing 44. As the level of toner particles in the chamber is decreased, fresh toner particles are furnished from the toner dispenser.

The maximum loading of induction charged, conductive toner onto the dielectric overcoated donor roll 42 is preferably limited to approximately a monolayer of toner. For a voltage $DC_L$ 302 greater than approximately 100 volts, the monolayer loading is essentially independent of bias level. The charge induced on the toner monolayer, however, is proportional to the voltage $DC_L$ 302. Accordingly, the charge-to-mass ratio of the toner loaded on donor roll 42 can be controlled according to the voltage $DC_L$ 302. As an example, if a $DC_L$ voltage of −200 volts is applied to load conductive toner onto donor roll 42 with a dielectric overcoating thickness of 25 microns, the toner charge-to-mass ratio is −17 microCoulombs per gram.

As the toned donor rotates in the direction indicated by arrow 69 in FIG. 2, it is desirable to condition the toner layer on the donor roll 42 before the development zone 310. The objective of the toner layer conditioning device is to remove any toner in excess of a monolayer. Without the toner layer conditioning device, toner-toner contacts in the development zone can cause wrong-sign toner generation and deposition in the nonimage areas. A toner layer conditioning device 400 is illustrated in FIG. 2. This particular example uses a compliant overcoated roll that is biased at a voltage $DC_C$ 304. The overcoating material is charge relaxable to enable dissipation of any charge accumulation. The voltage $DC_C$ 304 is set at a higher magnitude than the voltage $DC_L$ 302. For synchronous contact between the donor roll 42 and conditioning roll 400 under the bias voltage conditions, any toner on donor roll 42 that is on top of toner in the layer is induction charged with opposite polarity and deposited on the roll 400. A doctor blade on conditioning roll 400 continually removes the deposited toner.

As donor 42 is rotated further in the direction indicated by arrow 69, the now induction charged and conditioned toner layer is moved into development zone 310, defined by a synchronous contact between donor 42 and the photoreceptor belt 10. In the image areas, the toner layer on the donor roll is developed onto the photoreceptor by electric fields created by the latent image. In the nonimage areas, the electric fields prevent toner deposition. Since the adhesion of induction charged, conductive toner is typically less than that of triboelectrically charged toner, only DC electric fields are required to develop the latent electrostatic image in the development zone. The DC field is provided by both the DC voltages $DC_D$ 300 and $DC_L$ 302, and the electrostatic potentials of the latent image on photoconductor 10.

Since the donor roll 42 is overcoated with a highly insulative material, undesired charge can accumulate on the overcoating surface over extended development system operation. To eliminate any charge accumulation, a charge neutralizing device may be employed. One example of such device is illustrated in FIG. 2 whereby a rotating electrostatic brush 315 is brought into contact with the toned donor roll. The voltage on the brush 315 is set at or near the voltage applied to the core of donor roll 42.

An advantageous feature of nonmagnetic inductive charging is that the precharging of conductive, nonmagnetic toner prior to the development zone enables the application of an electrostatic force in the development zone for the prevention of background toner and the deposition of toner in the image areas. Background control and image development with an induction charged, nonmagnetic toner employs a process for forming a monolayer of toner that is brought into contact with an electrostatic image. Monolayer toner coverage is sufficient in providing adequate image optical density if the coverage is uniform. Monolayer coverage with small toner enables thin images desired for high image quality.

To understand how toner charge is controlled with nonmagnetic inductive charging, FIG. 3 illustrates a monolayer of induction charged toner on a dielectric overcoated substrate 42. The monolayer of toner is deposited on the substrate when a voltage $V_A$ is applied to conductive toner. The average charge density on the monolayer of induction charged toner is given by the formula $$\sigma = \frac{V_A \varepsilon_o}{(T_d/\kappa_d + 0.32\,R_p)} \tag{1}$$

where $T_d$ is the thickness of the dielectric layer, $\kappa_d$ is the dielectric constant, $R_p$ is the particle radius, and $\epsilon_o$ is the permittivity of free space. The 0.32 $R_p$ term (obtained from empirical studies) describes the average dielectric thickness of the air space between the monolayer of conductive particles and the insulative layer.

For a 25 micron thick dielectric layer ($\kappa_d$=3.2), toner radius of 6.5 microns, and applied voltage of −200 volts, the calculated surface charge density is −18 nC/cm$^2$. Since the toner mass density for a square lattice of 13 micron nonmagnetic toner is about 0.75 mg/cm$^2$, the toner charge-to-mass ratio is about −17 microCoulombs per gram. Since the toner charge level is controlled by the induction charging voltage and the thickness of the dielectric layer, one can expect that the toner charging will not depend on other factors such as the toner pigment, flow additives, relative humidity, or the like.

With an induction charged layer of toner formed on a donor roll or belt, the charged layer can be brought into contact with an electrostatic image on a dielectric receiver. FIG. 4 illustrates an idealized situation wherein a monolayer of previously induction Charged conductive spheres is sandwiched between donor 42 and receiver dielectric materials 10.

The force per unit area acting on induction charged toner in, the presence of an applied field from a voltage difference, $V_o$, between the donor and receiver conductive substrates is given by the equation $$F/A = -\frac{\sigma^2}{2\varepsilon_o}\left(\frac{T_r/\kappa_r + T_a^r - T_d/\kappa_d - T_a^d}{T_r/\kappa_r + T_d/\kappa_d + T_a^r + T_a^d}\right) + \frac{\sigma V_o}{T_r/\kappa_r + T_d/\kappa_d + T_a^r + T_a^d} - (F_{sr}^d - F_{sr}^r)$$

where $\sigma$ is the average charge density on the monolayer of induction charged toner (described by Equation 1), $T_r/\kappa_r$;

and $T_d/\kappa_d$ are the dielectric thicknesses of the receiver and donor, respectively, $T^r_a$ and $T^d_a$ are the average thicknesses of the receiver and donor air gaps, respectively, $V_o$ is the applied potential, $T_a$=0.32 $R_p$ where $R_p$ is the particle radius, $\epsilon_o$ is the permittivity of free space, and $F^r_{sr}$ and $F^d_{sr}$ are the short-range force per unit area at the receiver and donor interfaces, respectively. The first term, because of an electrostatic image force from neighboring particles, becomes zero when the dielectric thicknesses of the receiver and its air gap are equal to the dielectric thicknesses of the donor and its air gap. Under these conditions, the threshold applied voltage for transferring toner to the receiver should be zero if the difference in the receiver and donor short-range forces is negligible. One expects, however, a distribution in the short-range forces.

To illustrate the functionality of the nonmagnetic inductive charging device, the developer system of FIG. 2 was tested under the following conditions. A sump of toner (conducting toner of 13 micron volume average particle size) biased at a potential of −200 volts was placed in contact with a 25 micron thick MYLAR® (grounded aluminum on backside) donor belt moving at a speed of 4.2 inches per second. To condition the toner layer and to remove any loosely adhering toner, a 25 micron thick MYLAR® covered aluminum roll was biased at a potential of −300 volts and contacted with the toned donor belt at substantially the same speed as the donor belt. This step was repeated a second time. The conditioned toner layer was then contacted to an electrostatic image moving at substantially the same speed as the toned donor belt. The electrostatic image had a potential of −650 volts in the nonimage areas and −200 volts in the image areas. A DC potential of +400 volts was applied to the substrate of electrostatic image bearing member during synchronous contact development. A toned image with adequate optical density and low background was observed.

Nonmagnetic inductive charging systems based on induction charging of conductive toner prior to the development zone offer a number of advantages compared to electrophotographic development systems based on triboelectric charging of insulative toner. The toner charging depends only on the induction charging bias, provided that the toner conductivity is sufficiently high. Thus, the charging is insensitive to toner materials such as pigment and resin. Furthermore, the performance should not depend on environmental conditions such as relative humidity.

Nonmagnetic inductive charging systems can also be used in electrographic printing systems for printing black plus one or several separate custom colors with a wide color gamut obtained by blending multiple conductive, nonmagnetic color toners in a single component development system. The induction charging of conductive toner blends is generally pigment-independent. Each electrostatic image is formed with either ion or Electron Beam Imaging (EBI) and developed on separate electroreceptors. The images are tack transferred image-next-to-image onto a transfuse belt or drum for subsequent heat and pressure transfuse to a wide variety of media. The custom color toners, including metallics, are obtained by blending different combinations and percentages of toners from a set of nine primary toners plus transparent and black toners to control the lightness or darkness of the custom color. The blending of the toners can be done either outside of the electrophotographic printing system or within the system, in which situation the different proportions of color toners are directly added to the in-situ toner dispenser.

Figure 5:
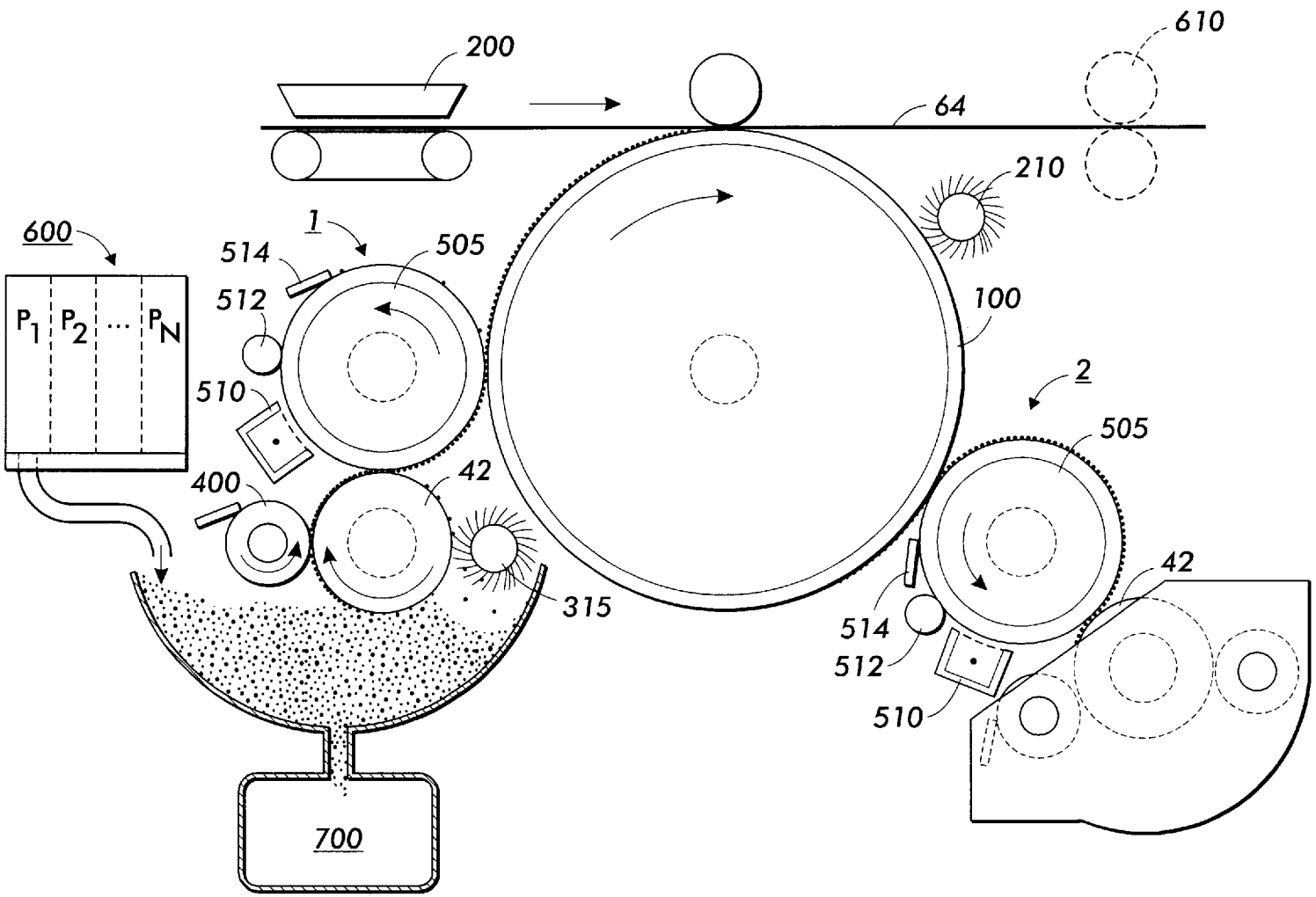
FIG. 5 is a schematic elevational view of an illustrative electrophotographic printing machine incorporating therein a nonmagnetic inductive charging development system for the printing of black and a custom color.

FIG. 5 illustrates the components and architecture of such a system for custom color printing. FIG. 5 illustrates two electroreceptor modules, although it is understood that additional modules can be included for the printing of multiple custom colors on a document. For discussion purposes, it is assumed that the second module 2 prints black toner. The electroreceptor module 2 uses a nonmagnetic, conductive toner single component development (SCD) system that has been described in FIG. 2. A conventional SCD system, however, that uses magnetic, conductive toner that is induction charged by the electrostatic image on the electroreceptor can also be used to print the black toner.

For the electroreceptor module 1 for the printing of custom color, an electrostatic image is formed on an electroreceptor drum 505 with either ion or Electron Beam Imaging device 510 as taught in U.S. Pat. No. 5,039,598, the disclosure of which is totally incorporated herein by reference. The nonmagnetic, single component development system contains a blend of nonmagnetic, conductive toners to produce a desired custom color. An insulative overcoated donor 42 is loaded with the induction charged blend of toners. A toner layer conditioning station 400 helps to ensure a monolayer of induction charged toner on the donor. (Monolayer toner coverage is sufficient to provide adequate image optical density if the coverage is uniform. Monolayer coverage with small toner particles enables thin images desired for high image quality.) The monolayer of induction charged toner on the donor is brought into synchronous contact with the imaged electroreceptor 505. (The development system assembly can be cammed in and out so that it is only in contact with warmer electroreceptor during copying/printing.) The precharged toner enables the application of an electrostatic force in the development zone for the prevention of background toner and the deposition of toner in the image areas. The toned image on the electroreceptor is tack transferred to the heated transfuse member 100 which can be a belt or drum. The covering on the compliant transfuse belt or drum typically consists of a thick (1.3 millimeter) soft (IRHD hardness of about 40) silicone rubber. Thinner and harder rubbers can provide tradeoffs in latitudes. The rubber can also have a thin VITON® top coat for improved reliability. If the transfuse belt/drum is maintained at a temperature near 120° C., tack transfer of the toner from the electroreceptor to the transfuse belt/drum can be obtained with a nip pressure of about 50 psi. As the toned image advances from the electroreceptor-transfuse drum nip for each module to the transfuse drum-medium transfuse nip, the toner is softened by the about 120° C. transfuse belt temperature. With the medium 64 (paper for purposes of this illustrative discussion although others can also be used) preheated by heater 200 to about 85° C., transfuse of the image to the medium is obtained with a nip pressure of about 100 psi. The toner release from the silicone belt can be aided by a small amount of silicone oil that is imbibed in the belt for toner release at the toner/belt interface. The bulk of the compliant silicone material also contains a conductive carbon black to dissipate any charge accumulation. As noted in FIG. 5, a cleaner 210 for the transfuse drum material is provided to remove residual toner and fiber debris. An optional glossing station 610 enables the customer to select a desired image gloss level. The electroreceptor cleaner 514 and erase bar 512 are provided to prepare for the next imaging cycle.

The illustrated black plus custom color(s) printing system enables improved image quality through the use of smaller toners (3 to 10 microns), such as toners prepared by an emulsion aggregation process.

The SCD system for module 1 shown in FIG. 5 inherently can have a small sump of toner, which is advantageous in switching the custom color to be used in the SCD system. The bulk of the blended toner can be returned to a supply bottle of the particular blend. The residual toner in the housing can be removed by vacuuming 700. SCD systems are advantaged compared to two-component developer systems, since in two-component systems the toner must be separated from the carrier beads if the same beads are to be used for the new custom color blend.

A particular custom color can be produced by offline equipment that blends a number of toners selected from a set of nine primary color toners (plus transparent and black toners) that enable a wide custom color gamut, such as PANTONE® colors. A process for selecting proportional amounts of the primary toners for in-situ addition to a SCD housing can be provided by dispenser 600. The color is controlled by the relative weights of primaries. The $P_1 \ldots P_N$ primaries can be selected to dispense toner into a toner bottle for feeding toner to a SCD housing in the machine, or to dispense directly to the sump of the SCD system on a periodic basis according to the amount needed based on the run length and area coverage. The dispensed toners are tumbled/agitated to blend the primary toners prior to use. In addition to the nine primary color toners for formulating a wide color gamut, one can also use metallic toners (which tend to be conducting and therefore compatible with the SCD process) which are desired for greeting, invitation, and name card applications. Custom color blends of toner can be made in an offline (paint shop) batch process; one can also arrange to have a set of primary color toners continuously feeding a sump of toner within (in-situ) the printer, which enables a dial-a-color system provided that an in-situ toner waste system is provided for color switching.

The toners of the present invention comprise particles typically having an average particle diameter of no more than about 13; microns, preferably no more than about 12 microns, more preferably no more than about 10 microns, and even more preferably no more than about 7 microns, although the particle size can be outside of these ranges, and typically have a particle size distribution of GSD equal to no more than about 1.25, preferably no more than about 1.23, and more preferably no more than about 1.20, although the particle size distribution can be outside of these ranges. In some embodiments, larger particles can be preferred even for those toners made by emulsion aggregation processes, such as particles of between about 7 and about 13 microns, because in these instances the toner particle surface area is relatively less with respect to particle mass and accordingly a lower amount by weight of conductive polymer with respect to toner particle mass can be used to obtain the desired particle conductivity or charging, resulting in a thinner shell of the conductive polymer and thus a reduced effect on the color of the toner. The toner particles comprise a vinyl resin, an optional colorant, and poly(3,4-ethylenedioxythiophene), wherein said toner particles are prepared by an emulsion aggregation process.

The toners of the present invention can be employed for the development of electrostatic images in processes such as electrography, electrophotography, ionography, and the like. Another embodiment of the present invention is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process. In one embodiment of the present invention, the toner particles are charged triboelectrically, in either a single component development process or a two-component development process. In another embodiment of the present invention, the toner particles are charged by an inductive charging process. In one specific embodiment employing inductive charging, the developing apparatus comprises a housing defining a reservoir storing a supply of developer material comprising the conductive toner; a donor member for transporting toner on an outer surface of said donor member to a development zone; means for loading a toner layer onto said outer surface of said donor member; and means for inductive charging said toner layer onto said outer surface of said donor member prior to the development zone to a predefined charge level. In a particular embodiment, the inductive charging means comprises means for biasing the toner reservoir relative to the bias on the donor member. In another particular embodiment, the developing apparatus further comprises means for moving the donor member into synchronous contact with the imaging member to detach toner in the development zone from the donor member, thereby developing the latent image. In yet another specific embodiment, the predefined charge level has an average toner charge-to-mass ratio of from about 5 to about 50 microCoulombs per gram in magnitude. Yet another specific embodiment of the present invention is directed to a process for developing a latent image recorded on a surface of an image receiving member to form a developed image, said process comprising (a) moving the surface of the image receiving member at a predetermined process speed; (b) storing in a reservoir a supply of toner particles according to the present invention; (c) transporting the toner particles on an outer surface of a donor member to a development zone adjacent the image receiving member; and (d) inductive charging said toner particles on said outer surface of said donor member prior to the development zone to a predefined charge level. In a particular embodiment, the inductive charging step includes the step of biasing the toner reservoir relative to the bias on the donor member. In another particular embodiment, the donor member is brought into synchronous contact with the imaging member to detach toner in the development zone from the donor member, thereby developing the latent image. In yet another particular embodiment, the predefined charge level has an average toner charge-to-mass ratio of from about 5 to about 50 microCoulombs per gram in magnitude.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory transfer. The developed toner image can also first be transferred to an intermediate transfer member, followed by transfer from the intermediate transfer member to the receiving member.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, adhesive spray fixing, and the like. Transfix or transfuse methods can also be employed, in which the developed image is transferred to an intermediate member and the image is then simultaneously transferred from the intermediate member and fixed or fused to the receiving member.

The toners of the present invention comprise particles typically having an average particle diameter of no more than about 10 microns, preferably no more than about. 7 microns, and more preferably no more than about 6.5 microns, although the particle size can be outside of these ranges, and typically have a particle size distribution of GSD equal to no more than about 1.25, preferably no more than about 1.23, and more preferably no more than about 1.20, although the particle size distribution can be outside of these ranges. The toner particles comprise a vinyl resin, an optional colorant, and poly(3,4-ethylenedioxythiophene).

The toners of the present invention comprise toner particles comprising a vinyl resin and an optional colorant. The resin can be a homopolymer of one vinyl monomer or a copolymer of two or more vinyl monomers. Examples of suitable monomers include styrenes, such as styrene, p-methyl styrene, m-methyl styrene, α-methyl styrene, and the like, acrylates, such as methyl acrylate, ethyl acrylate, propyl acrylate, butyl acrylate, β-carboxyethyl acrylate, and the like, methacrylates, such as methyl methacrylate, ethyl methacrylate, propyl methacrylate, butyl methacrylate, and the like, vinyl acrylic acids, such as acrylic acid, methacrylic acid, and the like, butadiene, isoprene, styrene sulfonic acid and salts thereof (such as sodium salts or the like), 4-vinylbenzene sulfonic acid and salts thereof (such as sodium salts or the like), vinylsulfonic acid and salts thereof (such as sodium salts or the like), 2-acrylamido-N-methylpropane sulfonic acid and salts thereof (such as sodium salts or the like), vinyl-1-pyridinium propane sulfonate and salts thereof (such as sodium salts or the like), and the like, as well as mixtures thereof. Examples of suitable resins include poly(styrene/butadiene), poly(p-methyl styrene/butadiene), poly(m-methyl styrene/butadiene), poly(α-methyl styrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly (methyl methacrylate/isoprene), poly(ethyl methacrylate/isoprene), poly(propyl methacrylate/isoprene), poly(butyl methacrylate/isoprene), poly(methyl acrylate/isoprene), poly(ethyl acrylate/isoprene), poly(propyl acrylate/isoprene), poly(butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), poly(styrene/n-butyl acrylate/styrene sulfonate sodium salt/acrylic acid), and the like, as well as mixtures thereof.

The resin is present in the toner particles in any desired or effective amount, typically at least about 75 percent by weight of the toner particles, and preferably at least about 85 percent by weight of the toner particles, and typically no more than about 99 percent by weight of the toner particles, and preferably no more than about 98 percent by weight of the toner particles, although the amount can be outside of these ranges. When no optional colorant is present, the amount of resin in the toner particles can also be higher than about 99 percent by weight.

Examples of suitable optional colorants include dyes and pigments, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed. When present, the optional colorant is present in the toner particles in any desired or effective amount, typically at least about 1 percent by weight of the toner particles, and preferably at least about 2 percent by weight of the toner particles, and typically no more than about 25 percent by weight of the toner particles, and preferably no more than about 15 percent by weight of the toner particles, depending on the desired particle size, although the amount can be outside of these ranges.

The toner particles optionally can also contain charge control additives, such as alkyl pyridinium halides, including cetyl pyridinium chloride and others as disclosed in U.S. Pat. No. 4,298,672, the disclosure of which is totally incorporated herein by reference, sulfates and bisulfates, including distearyl dimethyl ammonium methyl sulfate as disclosed in U.S. Pat. No. 4,560,635, the disclosure of which is totally incorporated herein by reference, and distearyl dimethyl ammonium bisulfate as disclosed in U.S. Pat. Nos. 4,937,157, 4,560,635, and copending application Ser. No. 07/396,497, now abandoned ,the disclosures of each of which are totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, charge control additives as disclosed in U.S. Pat. Nos. 3,944,493, 4,007,293, 4,079,014, 4,394,430, 4,464,452, 4,480,021, and 4,560,635, the disclosures of each of which are totally incorporated herein by reference, and the like, as well as mixtures thereof. Charge control additives are present in the toner particles in any desired or effective amounts, typically at least about 0.1 percent by weight of the toner articles, and typically no more than about 5 percent by weight of the toner particles, although the amount can be outside of this range.

Examples of optional surface additives include metal salts, metal salts of fatty acids, colloidal silicas, and the like, as well as mixtures thereof. External additives are present in any desired or effective amount, typically at least about 0.1 percent by weight of the toner particles, and typically no more than about 2 percent by weight of the toner particles, although the amount can be outside of this range, as disclosed in, for example, U.S. Pat. Nos. 3,590,000, 3,720,617, 3,655,374 and 3,983,045, the disclosures of each of which are totally incorporated herein by reference. Preferred additives include zinc stearate and AEROSIL R812® silica, available from Degussa. The external additives can be added during the aggregation process or blended onto the formed particles.

The toner particles of the present invention are prepared by an emulsion aggregation process. This process entails (1) preparing a colorant (such as a pigment) dispersion in a solvent (such as water), which dispersion comprises a colorant, a first ionic surfactant, and an optional charge control agent; (2) shearing the colorant dispersion with a latex mixture comprising (a) a counterionic surfactant with a charge polarity of opposite sign to that of said first ionic surfactant, (b) a nonionic surfactant, and (c) a resin, thereby causing flocculation or heterocoagulation of formed particles of colorant, resin, and optional charge control agent to form electrostatically bound aggregates, and (3) heating the electrostatically bound aggregates to form stable aggregates of at least about 1 micron in average particle diameter. Toner particle size is typically at least about 1 micron and typically no more than about 7 microns, although the particle size can be outside of this range. Heating can be at a temperature typically of from about 5 to about 50° C. above the resin glass transition temperature, although the temperature can be outside of this range, to coalesce the electrostatically bound aggregates, thereby forming toner particles comprising resin, optional colorant, and optional charge control agent. Alternatively, heating can be first to a temperature below the resin glass transition temperature to form electrostatically bound micron-sized aggregates with a narrow particle size distribution, followed by heating to a temperature above the resin glass transition temperature to provide coalesced micron-sized toner particles comprising resin, optional colorant, and optional charge control agent. The coalesced particles differ from the uncoalesced aggregates primarily in morphology; the uncoalesced particles have greater surface area, typically having a "grape cluster" shape, whereas the coalesced particles are reduced in surface area, typically having a "potato" shape or even a spherical shape. The particle morphology can be controlled by adjusting conditions during the coalescence process, such as pH, temperature, coalescence time, and the like. Optionally, an additional amount of an ionic surfactant (of the same polarity as that of the initial latex) or nonionic surfactant can be added to the mixture prior to heating to minimize subsequent further growth or enlargement of the particles, followed by heating and coalescing the mixture. Subsequently, the toner particles are washed extensively to remove excess water soluble surfactant or surface absorbed surfactant, and are then dried to produce (optionally colored) polymeric toner particles. An alternative process entails using a flocculating or coagulating agent such as poly(aluminum chloride) instead of a counterionic surfactant of opposite polarity to the ionic surfactant in the latex formation; in this process, the growth of the aggregates can be slowed or halted by adjusting the solution to a more basic pH (typically at least about 7 or 8, although the pH can be outside of this range), and, during the coalescence step, the solution can, if desired, be adjusted to a more acidic pH to adjust the particle morphology. The coagulating agent typically is added in an acidic solution (for example, a 1 molar nitric acid solution) to the mixture of ionic latex and dispersed optional colorant, and during this addition step the viscosity of the mixture increases. Thereafter, heat and stirring are applied to induce aggregation and formation of micron-sized particles. When the desired particle size is achieved, this size can be frozen by increasing the pH of the mixture, typically to from about 7 to about 8, although the pH can be outside of this range. Thereafter, the temperature of the mixture can be increased to the desired coalescence temperature, typically from about 80 to about 96° C., although the temperature can be outside of this range. Subsequently, the particle morphology can be adjusted by dropping the pH of the mixture, typically to values of from about 3.5 to about 7, although the pH can be outside of this range.

When particles are prepared without a colorant, the latex (usually around 40 percent solids) is diluted to the right solids loading (of around 12 to 15 percent by weight solids) and then under identical shearing conditions the counterionic surfactant or polyaluminum chloride is added until flocculation or heterocoagulation takes place.

Examples of suitable ionic surfactants include anionic surfactants, such as sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, DOWFAX®, available from Dow Chemical Co., and the like, as well as mixtures thereof. Anionic surfactants can be employed in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

Examples of suitable ionic surfactants also include cationic surfactants, such as dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof. Cationic surfactants can be employed in any desired or effective amounts, typically at least about 0.1 percent by weight of water, and typically no more than about 5 percent by weight of water, although the amount can be outside of this range. Preferably the molar ratio of the cationic surfactant used for flocculation to the anionic surfactant used in latex preparation from about 0.5:1 to about 4:1, and preferably from about 0.5:1 to about 2:1, although the relative amounts can be outside of these ranges.

Examples of suitable nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®, and the like, as well as mixtures thereof. The nonionic surfactant can be present in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

When a sulfonated monomer is to be included in the vinyl resin, several methods can be used to prepare the vinyl polymer. For example, since the sulfonated monomers are generally water soluble, in a batch emulsion polymerization process the sulfonated monomer can be added into the reactor with all of the other reactants at the beginning of the reaction. The reaction mixture is homogenized with some of the surfactant solution to produce a stable emulsified oil (containing the monomer) in water solution. Another method entails semicontinuous emulsion polymerization. In a specific embodiment of this method, a starve-fed semicontinuous process is used wherein the rate of monomer addition is equal to or less than the rate of monomer polymerization; this method enables better control over the composition of the polymer chains. To achieve the same polymer composition throughout the semicontinuous process, the monomer feed composition is kept constant. Yet another method is to add the sulfonated monomer into the aqueous initiator solution. This solution is fed into the reactor after the initial monomer seed solution is fed in. After a period of time, the remaining larger portion of emulsified monomer is fed in over a period of about 1 hour at a controlled rate and then continued to heat until polymerization is complete. Still another method is to add the sulfonated monomer in with the initial surfactant charge in the reactor prior to the addition of any monomer. Another method is to add the dissolved sulfonated monomer after all of the other monomers were added as a separate phase.

The emulsion aggregation process suitable for making the toner materials for the present invention has been disclosed in previous U.S. patents. For example, U.S. Pat. No. 5,290,654 (Sacripante et al.), the disclosure of which is totally incorporated herein by reference, discloses a process for the preparation of toner compositions which comprises dissolving a polymer, and, optionally a pigment, in an organic solvent; dispersing the resulting solution in an aqueous medium containing a surfactant or mixture of surfactants; stirring the mixture with optional heating to remove the organic solvent, thereby obtaining suspended particles of about 0.05 micron to about 2 microns in volume diameter; subsequently homogenizing the resulting suspension with an optional pigment in water and surfactant; followed by aggregating the mixture by heating, thereby providing toner particles with an average particle volume diameter of from between about 3 to about 21 microns when said pigment is present.

U.S. Pat. No. 5,278,020 (Grushkin et al.), the disclosure of which is totally incorporated herein by reference, discloses a toner composition and processes for the preparation thereof comprising the steps of: (i) preparing a latex emulsion by agitating in water a mixture of a nonionic surfactant, an anionic surfactant, a first nonpolar olefinic monomer, a second nonpolar diolefinic monomer, a free radical initiator, and a chain transfer agent; (ii) polymerizing the latex emulsion mixture by heating from ambient temperature to about 80° C. to form nonpolar olefinic emulsion resin particles of volume average diameter from about 5 nanometers to about 500 nanometers; (iii) diluting the a nonpolar olefinic emulsion resin particle mixture with water; (iv) adding too the diluted resin particle mixture a colorant or pigment particles and optionally dispersing the resulting mixture with a homogenizer; (v) adding a cationic surfactant to flocculate the colorant or pigment particles to the surface of the emulsion resin particles; (vi) homogenizing the flocculated mixture at high shear to form statically bound aggregated composite particles with a volume average diameter of less than or equal to about 5 microns; (vii) heating the statically bound aggregate composite particles to form nonpolar toner sized particles; (viii) optionally halogenating the nonpolar toner sized particles to form nonpolar toner sized particles having a halopolymer resin outer surface or encapsulating shell; and (ix) isolating the nonpolar toner sized composite particles.

U.S. Pat. No. 5,308,734 (Sacripante et al.), the disclosure of which is totally incorporated herein by reference, discloses a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

U.S. Pat. No. 5,346,797 (Kmiecik-Lawrynowicz et al.), the disclosure of which is totally incorporated herein by reference, discloses a process for the preparation of toner compositions comprising (i) preparing a pigment dispersion in a solvent, which dispersion comprises a pigment, an ionic surfactant, and optionally a charge control agent; (ii) shearing the pigment dispersion with a latex mixture comprising a counterionic surfactant with a charge polarity of opposite sign to that of said ionic surfactant, a nonionic surfactant, and resin particles, thereby causing a flocculation or heterocoagulation of the formed particles of pigment, resin, and charge control agent to form electrostatically bound toner size aggregates; and (iii) heating the statically bound aggregated particles to form said toner composition comprising polymeric resin, pigment and optionally a charge control agent.

U.S. Pat. No. 5,344,738 (Kmiecik-Lawrynowicz et al.), the disclosure of which is totally incorporated herein by reference, discloses a process for the preparation of toner compositions with a volume median particle size of from about 1 to about 25 microns, which process comprises: (i) preparing by emulsion polymerization an anionic charged polymeric latex of submicron particle size, and comprising resin particles and anionic surfactant; (ii) preparing a dispersion in water, which dispersion comprises optional pigment, an effective amount of cationic flocculant surfactant, and optionally a charge control agent; (iii) shearing the dispersion (ii) with the polymeric latex, thereby causing a flocculation or heterocoagulation of the formed particles of optional pigment, resin, and charge control agent to form a high viscosity gel in which solid particles are uniformly dispersed; (iv) stirring the above gel comprising latex particles and oppositely charged dispersion particles for an effective period of time to form electrostatically bound relatively stable toner size aggregates with narrow particle size distribution; and (v) heating the electrostatically bound aggregated particles at a temperature above the resin glass transition temperature, thereby providing the toner composition comprising resin, optional pigment, and optional charge control agent.

U.S. Pat. No. 5,364,729 (Kmiecik-Lawrynowicz et al.), the disclosure of which is totally incorporated herein by reference, discloses a process for the preparation of toner compositions comprising: (i) preparing a pigment dispersion, which dispersion comprises a pigment, an ionic surfactant, and optionally a charge control agent; (ii) shearing said pigment dispersion with a latex or emulsion blend comprising resin, a counterionic surfactant with a charge polarity of opposite sign to that of said ionic surfactant, and a nonionic surfactant; (iii) heating the above sheared blend below about the glass transition temperature (Tg) of the resin, to form electrostatically bound toner size aggregates with a narrow particle size distribution; and (iv) heating said bound aggregates above about the Tg of the resin.

U.S. Pat. No. 5,370,963 (Patel et al.), the disclosure of which is totally incorporated herein by reference, discloses a process for the preparation of toner compositions with controlled particle size comprising: (i) preparing a pigment dispersion in water, which dispersion comprises pigment, an ionic surfactant, and an optional charge control agent; (ii) shearing at high speeds the pigment dispersion with a polymeric latex comprising resin, a counterionic surfactant with a charge polarity of opposite sign to that of said ionic surfactant, and a nonionic surfactant, thereby forming a uniform homogeneous blend dispersion comprising resin, pigment, and optional charge agent; (iii) heating the above sheared homogeneous blend below about the glass transition temperature (Tg) of the resin while continuously stirring to form electrostatically bounded toner size aggregates with a narrow particle size distribution; (iv) heating the statically bound aggregated particles above about the Tg of the resin particles to provide coalesced toner comprising resin, pigment, and optional charge control agent, and subsequently optionally accomplishing (v) and (vi); (v) separating said toner; and (vi) drying said toner.

U.S. Pat. No. 5,403,693 (Patel et al.), the disclosure of which is totally incorporated herein by reference, discloses a process for the preparation of toner compositions with controlled particle size comprising: (i) preparing a pigment dispersion in water, which dispersion comprises a pigment, an ionic surfactant in amounts of from about 0.5 to about 10 percent by weight of water, and an optional charge control agent; (ii) shearing the pigment dispersion with a latex mixture comprising a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45° C. to about 90° C. and preferably from between about 50° C. and about 80° C. the statically bound aggregated particles to form said toner composition comprising resin, pigment, and optional charge control agent.

U.S. Pat. No. 5,418,108 (Kmiecik-Lawrynowicz et al.), the disclosure of which is totally incorporated herein by reference, discloses a process for the preparation of toner compositions with controlled particle size and selected morphology comprising (i) preparing a pigment dispersion in water, which dispersion comprises pigment, ionic surfactant, and optionally a charge control agent; (ii) shearing the pigment dispersion with a polymeric latex comprising resin of submicron size, a counterionic surfactant with a charge polarity of opposite sign to that of said ionic surfactant, and a nonionic surfactant, thereby causing a flocculation or heterocoagulation of the formed particles of pigment, resin, and charge control agent, and generating a uniform blend dispersion of solids of resin, pigment, and optional charge control agent in the water and surfactants; (iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles; (iv) heating the above formed aggregated particles about above the Tg of the resin to provide coalesced particles of toner; and optionally (v) separating said toner particles from water, and surfactants; and (vi) drying said toner particles.

U.S. Pat. No. 5,405,728 (Hopper et al.), the disclosure of which is totally incorporated herein by reference, discloses a process for the preparation of toner compositions comprising (i) preparing a pigment dispersion in water, which dispersion comprises a pigment, an ionic surfactant, and optionally a charge control agent; (ii) shearing the pigment dispersion with a latex containing a controlled solid contents of from about 50 weight percent to about 20 percent of polymer or resin, counterionic surfactant, and nonionic surfactant in water, counterionic surfactant with a charge polarity of opposite sign to that of said ionic surfactant, thereby causing a flocculation or heterocoagulation of the formed particles of pigment, resin, and charge control agent to form a dispersion of solids of from about 30 weight percent to 2 percent comprising resin, pigment, and optionally charge control agent in the mixture of nonionic, anionic, and cationic surfactants; (iii) heating the above sheared blend at a temperature of from about 5° to about 25° C. about below the glass transition temperature (Tg) of the resin while continuously stirring to form toner sized aggregates with a narrow size dispersity; and (iv) heating the electrostatically bound aggregated particles at a temperature of from about 5° to about 50° C. about above the (Tg) of the resin to provide a toner composition comprising resin, pigment, and optionally a charge control agent.

U.S. Pat. No. 5,869,215 (Ong et al.), the disclosure of which is totally incorporated herein by reference, discloses a process for the preparation of toner including (i) blending an aqueous colorant dispersion with a latex blend comprising a linear polymer and a soft crosslinked polymer; (ii) heating the resulting mixture at about below, or about equal to the glass transition temperature (Tg) of the linear latex polymer to form aggregates; and (iii) subsequently heating said aggregate suspension about above, or about equal to the Tg of the linear latex polymer to effect fusion or coalescence of said aggregates.

U.S. Pat. No. 5,869,216 (Ong et al.), the disclosure of which is totally incorporated herein by reference, discloses a process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25° C. to about 80° C.; and optionally isolating the toner product, washing, and drying.

U.S. Pat. No. 5,910,387 (Mychajlowskij et al.), the disclosure of which is totally incorporated herein by reference, discloses a toner composition comprising colorant, and an addition polymer resin of styrene, butadiene, acrylonitrile and acrylic acid.

U.S. Pat. No. 5,919,595 (Mychajlowskij et al.), the disclosure of which is totally incorporated herein by reference, discloses a process for the preparation of toner comprising mixing an emulsion latex, a colorant dispersion, and monocationic salt, and which mixture possesses an ionic strength of from about 0.001 molar (M) to about 5 molar, and optionally cooling.

U.S. Pat. No. 5,922,501 (Cheng et al.), the disclosure of which is totally incorporated herein by reference, discloses a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 (Mychajlowskij et al.), the disclosure of which is totally incorporated herein by reference, discloses a surfactant free process for the preparation of toner comprising heating a mixture of an emulsion latex, a colorant, and an organic complexing agent.

U.S. Pat. No. 5,366,841 (Patel et al.), the disclosure of which is totally incorporated herein by reference, discloses a process for the preparation of toner compositions comprising: (i) preparing a pigment dispersion in water, which dispersion comprises a pigment, an ionic surfactant, and optionally a charge control agent; (ii) shearing the pigment dispersion with a latex blend comprising resin particles, a counterionic surfactant with a charge polarity of opposite sign to that of said ionic surfactant, and a nonionic surfactant, thereby causing a flocculation or heterocoagulation of the formed particles of pigment, resin, and charge control agent to form a uniform dispersion of solids in the water, and surfactant; (iii) heating the above sheared blend at a critical temperature region about equal to or above the glass transition temperature (Tg) of the resin, while continuously stirring, to form electrostatically bounded toner size aggregates with a narrow particle size distribution and wherein said critical temperature is from about 0° C. to about 10° C. above the resin Tg, and wherein the resin Tg is from about 30° C. to about 65° C. and preferably in the range of from about 45° C. to about 65° C.; (iv) heating the statically bound aggregated particles from about 10° C. to about 45° C. above the Tg of the resin particles to provide a toner composition comprising polymeric resin, pigment, and optionally a charge control agent; and (v) optionally separating and drying said toner.

U.S. Pat. No. 5,501,935 (Patel et al.), the disclosure of which is totally incorporated herein by reference, discloses a process for the preparation of toner compositions consisting essentially of (i) preparing a pigment dispersion, which dispersion comprises a pigment, an ionic surfactant, and optionally a charge control agent; (ii) shearing said pigment dispersion with a latex or emulsion blend comprising resin, a counterionic surfactant with a charge polarity of opposite sign to that of said ionic surfactant, and a nonionic surfactant; (iii) heating the above sheared blend below about the glass transition temperature (Tg) of the resin to form electrostatically bound toner size aggregates with a narrow particle size distribution; (iv) subsequently adding further anionic or nonionic surfactant solution to minimize further growth in the coalescence (v); and (v) heating said bound aggregates above about the Tg of the resin and wherein said heating is from a temperature of about 103° to about 120° C., and wherein said toner compositions are spherical in shape.

U.S. Pat. No. 5,496,676 (Croucher et al.), the disclosure of which is totally incorporated herein by reference, discloses a process comprising: (i) preparing a pigment dispersion comprising pigment, ionic surfactant, and optional charge control agent; (ii) mixing at least two resins in the form of latexes, each latex comprising a resin, ionic and nonionic surfactants, and optionally a charge control agent, and wherein the ionic surfactant has a countercharge to the ionic surfactant of (i) to obtain a latex blend; (iii) shearing said pigment dispersion with the latex blend of (ii) comprising resins, counterionic surfactant with a charge polarity of opposite sign to that of said ionic surfactant, and a nonionic surfactant; (iv) heating the above sheared blends of (iii) below about the glass transition temperature (Tg) of the resin, to form electrostatically bound toner size aggregates with a narrow particle size distribution; and (v) subsequently adding further anionic surfactant solution to minimize further growth of the bound aggregates (vi); (vi) heating said bound aggregates above about the glass transition temperature Tg of the resin to form stable toner particles; and optionally (vii) separating and drying the toner.

U.S. Pat. No. 5,527,658 (Hopper et al.), the disclosure of which is totally incorporated herein by reference, discloses a process for the preparation of toner comprising: (i) preparing a pigment dispersion comprising pigment, an ionic surfactant, and optionally a charge control agent; (ii) shearing said pigment dispersion with a latex comprising resin, a counterionic surfactant with a charge polarity of opposite sign to that of said ionic surfactant, and a nonionic surfactant; (iii) heating the above sheared blend of (ii) about below the glass transition temperature (Tg) of the resin, to form electrostatically bound toner size aggregates with a volume average diameter of from between about 2 and about 15 microns and with a narrow particle size distribution as reflected in the particle diameter GSD of between about 11.15 and about 1.30, followed by the addition of a water insoluble transition metal containing powder ionic surfactant in an amount of from between about 0.05 and about 5 weight percent based on the weight of the aggregates; and (iv) heating said bound aggregates about above the Tg of the resin to form toner.

U.S. Pat. No. 5,585,215 (Ong et al.), the disclosure of which is totally incorporated herein by reference, discloses a toner comprising color pigment and an addition polymer resin, wherein said resin is generated by emulsion polymerization of from 70 to 85 weight percent of styrene, from about 5 to about 20 weight percent of isoprene, from about 1 to about 15 weight percent of acrylate, or from about 1 to about 15 weight percent of methacrylate, and from about 0.5 to about 5 weight percent of acrylic acid.

U.S. Pat. No. 5,650,255 (Ng et al.), the disclosure of which is totally incorporated herein by reference, discloses an in situ chemical process for the preparation of toner comprising (i) the provision of a latex, which latex comprises polymeric resin particles, an ionic surfactant, and a nonionic surfactant; (ii) providing a pigment dispersion, which dispersion comprises a pigment solution, a counterionic surfactant with a charge polarity of opposite sign to that of said ionic surfactant, and optionally a charge control agent; (iii) mixing said pigment dispersion with said latex with a stirrer equipped with an impeller, stirring at speeds of from about 100 to about 900 rpm for a period of from about 10 minutes to about 150 minutes; (iv) heating the above resulting blend of latex and pigment mixture to a temperature below about the glass transition temperature (Tg) of the resin to form electrostatically bound toner size aggregates; (v) adding further aqueous ionic surfactant or stabilizer in the range amount of from about 0.1 percent to 5 percent by weight of reactants to stabilize the above electrostatically bound toner size aggregates; (vi) heating said electrostatically bound toner sized aggregates above about the Tg of the resin to form toner size particles containing pigment, resin and optionally a charge control agent; (vii) optionally isolating said toner, optionally washing with water; and optionally (viii) drying said toner.

U.S. Pat. No. 5,650,256 (Veregin et al.), the disclosure of which is totally incorporated herein by reference, discloses a process for the preparation of toner comprising: (i) preparing a pigment dispersion, which dispersion comprises a pigment and an ionic surfactant; (ii) shearing said pigment dispersion with a latex or emulsion blend comprising resin, a counterionic surfactant with a charge polarity of opposite sign to that of said ionic surfactant, and a nonionic surfactant, and wherein said resin contains an acid functionality; (iii) heating the above sheared blend below about the glass transition temperature (Tg) of the resin to form electrostatically bound toner size aggregates; (iv) adding anionic surfactant to stabilize the aggregates obtained in (iii); (v) coalescing said aggregates by heating said bound aggregates above about the Tg of the resin; (vi) reacting said resin of (v) with acid functionality with a base to form an acrylic acid salt, and which salt is ion exchanged in water with a base or a salt, optionally in the presence of metal oxide particles, to control the toner triboelectrical charge, which toner comprises resin and pigment; and (vii) optionally drying the toner obtained.

U.S. Pat. No. 5,376,172 (Tripp et al.), the disclosure of which is totally incorporated herein by reference, discloses a process for preparing silane metal oxides comprising reacting a metal oxide with an amine compound to form an amine metal oxide intermediate, and subsequently reacting said intermediate with a halosilane. Also disclosed are toner compositions for electrostatic imaging processes containing the silane metal oxides thus prepared as charge enhancing additives.

Copending Application U.S. Ser. No. 09/173,405, filed Oct. 15, 1998, now U.S. Pat. No. 6,132,924, entitled "Toner Coagulant Processes," with the named inventors Raj D. Patel, Michael A. Hopper, and Richard P. Veregin, the disclosure of which is totally incorporated herein by reference, discloses a process for the preparation of toner which comprises mixing a colorant, a latex, and two coagulants, followed by aggregation and coalescence. In one embodiment, the first coagulant is a polyaluminum hydroxy halide and the second coagulant is a cationic surfactant.

In a particularly preferred embodiment of the present invention (with example amounts provided to indicate relative ratios of materials), the emulsion aggregation process entails diluting with water (646.1 grams) an aqueous pigment dispersion solution (14.6 grams) containing 51.4 percent by weight solids of Pigment (Blue Cyan 15:3) dispersed into an anionic surfactant solution and stirred at low shear of 400 revolutions per minute using a homogenizer. Slowly 249.4 grams of an emulsion latex (40.00 percent by weight solids; prepared by emulsion polymerization of styrene, n-butyl acrylate, and acrylic acid monomers initiated with ammonium persulfate and stabilized with NEOGEN R and ANTARAOX CA-897 surfactants) is added. The ratio of monomers is about 82 percent by weight styrene and about 18 percent by weight n-butyl acrylate. For every 100 parts by weight of monomer, 2 parts by weight of acrylic acid is added to the monomer mixture. To this well stirred (4,000 to 5,000 revolutions per minute) pigmented latex dispersion is added an acidic solution consisting of 1 molar nitric acid (7.5 grams) and 3.2 grams of the flocculant poly(aluminum chloride), and as the acidic flocculant solution is added the solution viscosity generally increases. The mixture is transferred into a 2 liter glass reaction kettle equipped with an overhead stirrer, temperature probe, and water-jacketed heating mantle to control the reaction temperature. The particles are heated at about 1° C. per minute up to about 50° C. to produce the particle size of approximately 0.5 microns smaller than desired. At this point the shell latex which is approximately 25 to 30 weight percent of the total latex, and of identical composition to the latex already used is added (106.98 grams). The aggregation is continued until the desired particle size and size distribution is reached. The particle size and size distribution are then frozen by adjusting the reaction pH to 7.5 with 4 percent sodium hydroxide solution. The reactor temperature is increased to about 95° C. for coalescence, and the pH is dropped to about 4.0 by adding 1 molar nitric acid solution. The particles are then coalesced by heating at 95° C. for approximately 3 hours. After cooling, the particle suspension is washed with deionized water and filtered through a 1.2 micron porous filter paper. The filtered particles are re-suspended in water for approximately 0.5 to 1 hour and then filtered again through the 1.2 micron porous filter paper. This washing step is repeated 4 to 5 times. The particles are now ready for the conductive polymer surface treatment.

When particles without colorant are desired, the emulsion aggregation process entails diluting with water (761.43 grams) 375 rams of an emulsion latex (40.00 percent by weight solids; prepared by emulsion polymerization of styrene, n-butyl acrylate, and acrylic acid monomers initiated with ammonium persulfate and stabilized with NEOGEN R and ANTARAOX CA-897 surfactants). The ratio of monomers is about 82 percent by weight styrene and about 18 percent by weight n-butyl acrylate. For every 100 parts by weight of monomer, 2 parts by weight of acrylic acid is added to the monomer mixture. To this well stirred (4,000 to 5,000 revolutions per minute) latex dispersion is added an acidic solution consisting of 1 molar nitric acid (7.86 grams) and 3.35 grams of the flocculant poly(aluminum chloride), and as the acidic flocculant solution is added the solution viscosity generally increases. The mixture is transferred into a 2 liter glass reaction kettle equipped with an overhead stirrer, temperature probe, and water-jacketed heating mantle to control the reaction temperature. The particles are heated at about 1° C. per minute up to about 50° C. to produce the desired particle size and size distribution. The particle size and size distribution are then frozen by adjusting the reaction pH to 7.5 with 4 percent sodium hydroxide solution. The reactor temperature is in creased to about 95° C. for coalescence, and the pH is dropped to about 4.0 by adding 1 molar nitric acid solution. The particles are then coalesced by heating at 95° C. for approximately 3 hours. After cooling, the particle suspension is washed with deionized water and filtered through a 1.2 micron porous filter paper. The filtered particles are re-suspended in water for approximately 0.5 to 1 hour and then filtered again through the 1.2 micron porous filter paper. This washing step is repeated 4 to 5 times. The particles are now ready for the conductive polymer surface treatment.

Subsequent to synthesis of the toner particles, the toner particles are washed, preferably with water. Thereafter, a poly(3,4-ethylenedioxythiophene), which, in its reduced form is of the formula

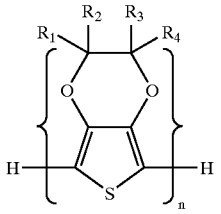

wherein each of $R_1$, $R_2$, $R_3$, and $R_4$, independently of the others, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein the substituents on the substituted alkyl, alkoxy, aryl, aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units, is applied to the particle surfaces by an oxidative polymerization process. The toner particles are suspended in a solvent in which the toner particles will not dissolve, such as water, methanol, ethanol, butanol, acetone, acetonitrile, blends of water with methanol, ethanol, butanol, acetone, acetonitrile, and/or the like, preferably in an amount of from about 5 to about 20 weight percent toner particles in the solvent, and the 3,4-ethylenedioxythiophene monomer is added slowly (a typical addition time period would be over about 10 minutes) to the solution with stirring. The 3,4-ethylenedioxythiophene monomer typically is added in an amount of from about 5 to about 15 percent by weight of the toner particles. The 3,4-ethylenedioxythiophene monomer, of the formula

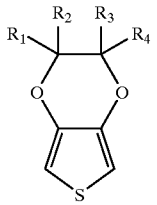

wherein $R_1$, $R_2$, $R_3$, and $R_4$ are as defined above, is hydrophobic, and it is desired that the monomer become adsorbed onto the toner particle surfaces. Thereafter, the solution is stirred for a period of time, typically from about 0.5 to about 3 hours to enable the monomer to be absorbed into the toner particle surface. When a dopant is employed, it is typically added at this stage, although it can also be added after addition of the oxidant. Subsequently, the oxidant selected is dissolved in a solvent sufficiently polar to keep the particles from dissolving therein, such as water, methanol, ethanol, butanol, acetone, acetonitrile, or the like, typically in a concentration of from about 0.1 to about 5 molar equivalents of oxidant per molar equivalent of 3,4-ethylenedioxythiophene monomer, and slowly added dropwise with stirring to the solution containing the toner particles. The amount of oxidant added to the solution typically is in a molar ratio of 1:1 or less with respect to the 3,4-ethylenedioxythiophene, although a molar excess of oxidant can also be used and can be preferred in some instances. The oxidant is preferably added to the solution subsequent to addition of the 3,4-ethylenedioxythiophene monomer so that the 3,14-ethylenedioxythiophene has had time to adsorb onto the toner particle surfaces prior to polymerization, thereby enabling the 3,4-ethylenedioxythiophene to polymerize on the toner particle surfaces instead of forming separate particles in the solution. When the oxidant addition is complete, the solution is again stirred for a period of time, typically from about 1 to about 2 days, although the time can be outside of this range, to allow the polymerization and doping process to occur. Thereafter, the toner particles having poly(3,4-ethylenedioxythiophene) polymerized on the surfaces thereof are washed, preferably with water, to remove therefrom any poly(3,4-ethylenedioxythiophene) that formed in the solution as separate particles instead of as a coating on the toner particle surfaces, and the toner particles are dried. The entire process typically takes place at about room temperature (typically from about 15 to about 30° C.), although lower temperatures can also be used if desired.

Particularly preferred $R_1$, $R_2$, $R_3$, and $R_4$ groups on the 3,4-ethylenedioxythiophene monomer and poly(3,4-ethylenedioxythiophene) polymer include hydrogen atoms, linear alkyl groups of the formula —$(CH_2)_nCH_3$ wherein n is an integer of from 0 to about 16, linear alkyl sulfonate groups of the formula —$(CH_2)_nSO_3$–M+ wherein n is an integer of from 1 to about 6 and M is a cation, such as sodium, potassium, other monovalent cations, or the like, and linear alkyl ether groups of the formula —$(CH_{2)n}OR_3$ wherein n is an integer of from 0 to about 6 and $R_3$ is a hydrogen atom or a linear alkyl group of the formula —$(CH_2)_mCH_3$ wherein n is an integer of from 0 to about 6. Specific examples of preferred 3,4-ethylenedioxythiophene monomers include those with $R_1$ and $R_3$ as hydrogen groups and $R_2$ and $R_4$ groups as follows:

| $R_2$ | $R_4$ |
|---|---|
| H | H |
| $(CH_2)_nCH_3$<br>n = 0–14 | H |
| $(CH_2)_nCH_3$<br>n = 0–14 | $(CH_2)_nCH_3$<br>n = 0–14 |
| $(CH_2)_nSO_3$—$Na^+$<br>n = 1–6 | H |
| $(CH_2)_nSO_3$—$Na^+$<br>n = 1–6 | $(CH_2)_nSO_3$—$Na^+$<br>n = 1–6 |
| $(CH_2)_nOR_6$<br>n = 0–4<br>$R_6$=H, $(CH_2)_mCH_3$<br>m = 0–4 | H |
| $(CH_2)_nOR_6$<br>n = 0–4<br>$R_6$=H, $(CH_2)_mCH_3$<br>m = 0–4 | $(CH_2)_nOR_6$<br>n = 0–4<br>$R_6$=H, $(CH_2)_mCH_3$<br>m = 0–4 |

Unsubstituted 3,4-ethylenedioxythiophene monomer is commercially available from, for example Bayer AG. Substituted 3,4-ethylenedioxythiophene monomers can be prepared by known methods. For example, the substituted thiophene monomer 3,4-ethylenedioxythiophene can be synthesized following early methods of Fager (Fager, E. W. *J. Am. Chem. Soc.* 1945, 67, 2217), Becker et al. (Becker, H. J.; Stevens, W. *Rec. Trav. Chim.* 1940, 59, 435) Guha and Iyer (Guha, P. C., Iyer, B. H.; *J. Ind. Inst. Sci.* 1938, A21, 115), and Gogte (Gogte, V. N.; Shah, L. G.; Tilak, B. D.; Gadekar, K. N.; Sahasrabudhe, M. B.; *Tetrahedron*, 1967, 23, 2437). More recent references for the EDOT synthesis and 3,4-alkylenedioxythiophenes are the following: Pei, Q.; Zuccarello, G.; Ahlskog, M.; Inganas, O. *Polymer*, 1994, 35(7), 1347; Heywang, G.; Jonas, F. *Adv. Mater.* 1992, 4(2), 116; Jonas, F.; Heywang, G.; *Electrochimica Actap.* 1994, 39(8/9), 1345; Sankaran, B.; Reynolds, J. R.; *Macromolecules*, 1997, 30, 2582; Coffey, M.; McKellar, B. R.; Reinhardt, B. A.; Nijakowski, T.; Feld, W. A.; *Syn. Commun.*, 1996, 26(11), 2205; Kumar, A.; Welsh, D. M.; Morvant, M. C.; Piroux, F.; Abboud, K. A.; Reynolds, J. R. *Chem. Mater.* 1998, 10, 896; Kumar, A.; Reynolds, J. R. *Macromolecules*, 1996, 29, 7629; Groenendaal, L.; Jonas, F.; Freitag, D.; Pielartzik, H.; Reynolds, J. R.; *Adv. Mater.* 2000, 12(7), 481; and U.S. Pat. No. 5,035,926, the disclosures of each of which are totally incorporated herein by reference. The synthesis of poly(3,4-ethylenedioxypyrrole)s and 3,4-ethylenedioxypyrrole monomers is also disclosed in Merz, A., Schropp, R., Dötterl, E., Synthesis, 1995, 795; Reynolds, J. R.; Brzezinski, J., DuBois, C. J., Giurgiu, I., Kloeppner, L., Ramey, M. B., Schottland, P., Thomas, C., Tsuie, B. M., Welsh, D. M., Zong, K., *Polym. Prepr. Am. Chem. Soc. Div. Polym. Chem*, 1999, 40(2), 1192; Thomas, C. A., Zong, K., Schottland, P., Reynolds, J. R., Adv. Mater., 2000, 12(3), 222; Thomas, C. A., Schottland, P., Zong, K, Reynolds, J. R., Polym. *Prepr. Am. Chem. Soc. Div. Polym. Chem*, 1999, 40(2), 615; and Gaupp, C. L., Zong, K., Schottland, P., Thompson, B. C., Thomas, C. A., Reynolds, J. R., *Macromolecules*, 2000, 33, 1132; the disclosures of each of which are totally incorporated herein by reference.

An example of a monomer synthesis is as follows:

Thiodiglycolic acid (1, 50 grams, commercially available from Aldrich or Fluka) is dissolved in methanol (200 milliliters) and concentrated sulfuric acid (57 milliliters) is added slowly with continuous stirring. After refluxing for 16 to 24 hours, the reaction mixture is cooled and poured into water (300 milliliters). The product is extracted with diethyl ether (200 milliliters) and the organic layer is repeatedly washed with saturated aqueous $NaHCO_3$, dried with $MgSO_4$, and concentrated by rotary evaporation. The residue is distilled to give colorless dimethyl thiodiglycolate (2, 17 grams). If the solvent is changed to ethanol the resulting product obtained is diethyl thiodiglycolate (3).

A solution of 2 and diethyl oxalate (4, 22 grams, commercially available from Aldrich) in methanol (100 milliliters) is added dropwise into a cooled (0° C.) solution of sodium methoxide (34.5 grams) in methanol (150 milliliters). After the addition is completed, the mixture is refluxed for 1 to 2 hours. The yellow precipitate that forms is filtered, washed with methanol, and dried in vacuum at room temperature. A pale yellow powder of disodium 2,5-dicarbomethoxy-3,4-dioxythiophene (5) is obtained in 100 percent yield (28 grams). The disodium 2,5-dicarbethyoxy-3,4-dioxythiophene (6) derivative of 5 can also be used instead of the methoxy derivative. This material is prepared similarly to 5 except 3 and diethyl oxalate (4) in ethanol is added dropwise into a cooled solution of sodium ethoxide in ethanol.

The salt either 5 or 6 is dissolved in water and acidified with 1 Molar HCl added slowly dropwise with constant stirring until the solution becomes acidic. Immediately following, thick white precipitate falls out. After filtration, the precipitate is washed with water and air-dried to give 2,5-dicarbethoxy-3,4-dihydroxythiophene (7). The salt either (5, 2.5 grams) or 6 can be alkylated directly or the dihydrothiophene derivative (7) can be suspended in the appropriate 1,2-dihaloalkane or substituted 1,2-dihaloalkane and refluxed for 24 hours in the presence of anhydrous $K_{2CO3}$ in anhydrous DMF. To prepare EDOT, either 1,2-dicholorethane (commercially available from Aldrich) or 1,2-dibromoethane (commercially from Aldrich) is used. To prepare the various substituted EDOT derivatives the appropriate 1,2-dibromoalkane is used, such as 1-dibromodecane, 1,2-dibromohexadecane (prepared from 1-hexadecene and bromine), 1,2-dibromohexane, other reported 1,2-dibromoalkane derivatives, and the like. The resulting 2,5-dicarbethoxy-3,4-ethylenedioxythiophene or 2,5-dicarbethoxy-3,4-alkylenedioxythiophene is refluxed in base, for example 10 percent aqueous sodium hydroxide solution for 1 to 2 hours, and the resulting insoluble material is collected by filtration. This material is acidified with 1 Normal HCl and recrystallized from methanol to produce either 2,5-dicarboxy-3,4-ethylenedioxythiophene or the corresponding 2,5-dicarboxy-3,4-alkylenedioxythiophene. The final step to reduce the carboxylic acid functional groups to hydrogen to produce the desired monomer is given in the references above.

Examples of suitable oxidants include water soluble persulfates, such as ammonium persulfate, potassium persulfate, and the like, cerium (IV) sulfate, ammonium cerium (IV) nitrate, ferric salts, such as ferric chloride, iron (III) sulfate, ferric nitrate nanohydrate, tris(p-toluenesulfonato)iron (III) (commercially available from Bayer under the tradename BAYTRON C), and the like. The oxidant is typically employed in an amount of at least about 0.1 molar equivalent of oxidant per molar equivalent of 3,4-ethylenedioxythiophene monomer, preferably at least about 0.25 molar equivalent of oxidant per molar equivalent of 3,4-ethylenedioxythiophene monomer, and more preferably at least about 0.5 molar equivalent of oxidant per molar equivalent of 3,4-ethylenedioxythiophene monomer, and typically is employed in an amount of no more than about 5 molar equivalents of oxidant per molar equivalent of 3,4-ethylenedioxythiophene monomer, preferably no more than about 4 molar equivalents of oxidant per molar equivalent of 3,4-ethylenedioxythiophene monomer, and more preferably no more than about 3 molar equivalents of oxidant per molar equivalent of 3,4-ethylenedioxythiophene monomer, although the relative amounts of oxidant and 3,4-ethylenedioxythiophene can be outside of these ranges.

The molecular weight of the poly(3,4-ethylenedioxythiophene) formed on the toner particle surfaces need not be high; typically the polymer can have about three or more repeat 3,4-ethylenedioxythiophene units, and more typically about six or more repeat 3,4-ethylenedioxythiophene units to enable the desired toner particle conductivity. If desired, however, the molecular weight of the poly(3,4-ethylenedioxythiophene) formed on the toner particle surfaces can be adjusted by varying the molar ratio of oxidant to monomer (EDOT), the acidity of the medium, the reaction time of the oxidative polymerization, and/or the like. In specific embodiments, the polymer has at least about 6 repeat 3,4-ethylenedioxythiophene units, and the polymer has no more than about 100 repeat (3,4-ethylenedioxythiophene) units. Molecular weights wherein the number of EDOT repeat monomer units is about 1,000 or higher can be employed, although higher molecular weights tend to make the material more Insoluble and therefore more difficult to process.

Alternatively, instead of coating the poly(3,4-ethylenedioxythiophene) onto the toner particle surfaces, the poly(3,4-ethylenedioxythiophene) can be incorporated into the toner particles during the toner preparation process. For example, the poly(3,4-ethylenedioxythiophene) polymer can be prepared during the aggregation of the toner latex process to make the toner size particles, and then as the particles coalesced, the poly(3,4-ethylenedioxythiophene) polymer can be included within the interior of the toner particles in addition to some polymer remaining on the surface. Another method of incorporating the poly(3,4-ethylenedioxythiophene) within the toner particles is to perform the oxidative polymerization of the 3,4-ethylenedioxythiophene monomer on the aggregated toner particles prior to heating for particle coalescence. As the irregular shaped particles are coalesced with the poly(3,4-ethylenedioxythiophene) polymer the polymer can be embedded or partially mixed into the toner particles as the particle coalesce. Yet another method of incorporating poly (3,4-ethylenedioxythiophene) within the toner particles is to add the 3,4-ethylenedioxythiophene monomer, dopant, and oxidant after the toner particles are coalesced and cooled but before any washing is performed. The oxidative polymerization can, if desired, be performed in the same reaction kettle to minimize the number of process steps.

In addition to polymerizing the 3,4-ethylenedioxythiophene monomer in the toner particle and/or on the toner particle surface, an aqueous dispersion of poly(3,4-ethylenedioxythiophene,) (such as that commercially available under the tradename BAYTRON P from Bayer) can be used to produce a conductive surface on the toner particles by adding some of the aqueous dispersion of poly(3,4-ethylenedioxythiophene) to the washed aggregated/coalesced toner particles, or by adding the aqueous dispersion of poly(3,4-ethylenedioxythiophene) during the aggregation process, thereby including the poly(3,4-ethylenedioxythiophene) into the interior of the toner particles and also on the surface of the toner particles. Additionally, the aqueous dispersion of poly(3,4-ethylenedioxythiophene) can be added after aggregation but prior to coalescence; further, the aqueous dispersion of poly(3,4-ethylenedioxythiophene) can be added after aggregation and coalescence has occurred but before the particles are washed.

When the toner is used in a process in which the toner particles are triboelectrically charged, the poly(3,4-ethylenedioxythiophene) can be in its reduced form. To achieve the desired toner particle conductivity for toners suitable for nonmagnetic inductive charging processes, it is sometimes desirable for the poly(3,4-ethylenedioxythiophene) to be in its oxidized form. The poly(3,4-ethylenedioxythiophene) can be shifted to its oxidized form by doping it with dopants such as sulfonate, phosphate, or phosphonate moieties, iodine, mixtures thereof, or the like. Poly(3,4-ethylenedioxythiophene) in its doped and oxidized form is believed to be of the formula

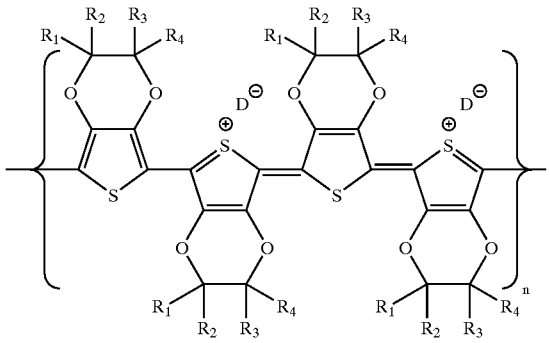

where $R_1$, $R_2$, $R_3$, and $R_4$ are as defined above, D− corresponds to the dopant, and n is an integer representing the number of repeat monomer unit. For example, poly(3,4-ethylenedioxythiophene) in its oxidized form and doped with sulfonate moieties is believed to be of the formula

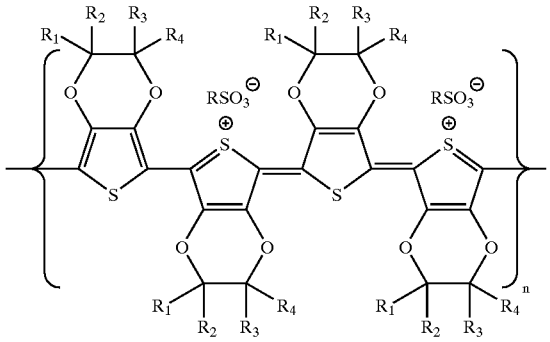

wherein $R_1$, $R_2$, $R_3$, and $R_4$ are as defined above, R corresponds to the organic portion of the sulfonate dopant molecule, such as an alkyl group, including linear, branched, saturated, unsaturated, cyclic, and substituted alkyl groups, typically with from 1 to about 20 carbon atoms and preferably with from about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, wherein the substituents on the substituted alkyl, alkoxy, aryl, aryloxy, arylalkyl, alkylaryl, arylalkyloxy, and alkylaryloxy groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

One method of causing the poly(3,4-ethylenedioxythiophene) to be doped is to select as the vinyl toner resin a sulfonated vinyl toner resin. In this embodiment, some of the repeat monomer units in the vinyl polymer have sulfonate groups thereon. The sulfonated vinyl resin has surface exposed sulfonate groups that serve the dual purpose of anchoring and doping the coating layer of poly(3,4-ethylenedioxythiophene) onto the toner particle surface.

Another method of causing the poly(3,4-ethylenedioxythiophene) to be doped is to place groups such as sulfonate moieties on the toner particle surfaces during the toner particle synthesis. For example, the ionic surfactant selected for the emulsion aggregation process can be an anionic surfactant having a sulfonate group thereon, such as sodium dodecyl sulfonate, sodium dodecylbenzene sulfonate, dodecylbenzene sulfonic acid, dialkyl benzenealkyl sulfonates, such as 1,3-benzene disulfonic acid sodium salt, para-ethylbenzene sulfonic acid sodium salt, and the like, sodium alkyl naphthalene sulfonates, such as 1,5-naphthalene disulfonic acid sodium salt, 2-naphthalene disulfonic acid, and the like, sodium poly(styrene sulfonate), and the like, as well as mixtures thereof. During the emulsion polymerization process, the surfactant becomes grafted and/or adsorbed onto the latex particles that are later aggregated and coalesced. While the toner particles are washed subsequent to their synthesis to remove surfactant therefrom, some of this surfactant still remains on the particle surfaces, and in sufficient amounts to enable doping of the poly(3,4-ethylenedioxythiophene) so that it is desirably conductive.

Yet another method of causing the poly(3,4-ethylenedioxythiophene) to be doped is to add small dopant molecules containing sulfonate, phosphate, or phosphonate groups to the toner particle solution before, during, or after the oxidative polymerization of the 3,4-ethylenedioxythiophene. For example, after the toner particles have been suspended in the solvent and prior to addition of the 3,4-ethylenedioxythiophene, the dopant can be added to the solution. When the dopant is a solid, it is allowed to dissolve prior to addition of the 3,4-ethylenedioxythiophene monomer, typically for a period of about 0.5 hour. Alternatively, the dopant can be added after addition of the 3,4-ethylenedioxythiophene and before addition of the oxidant, or after addition of the oxidant, or at any other time during the process. The dopant is added to the poly(3,4-ethylenedioxythiophene) in any desired or effective amount, typically at least about 0.1 molar equivalent of dopant per molar equivalent of 3,4-ethylenedioxythiophene monomer, preferably at least about 0.25 molar equivalent of dopant per molar equivalent of 3,4-ethylenedioxythiophene monomer, and more preferably at least about 0.5 molar equivalent of dopant per molar equivalent of 3,4-ethylenedioxythiophene monomer, and typically no more than about 5 molar equivalents of dopant per molar equivalent of 3,4-ethylenedioxythiophene monomer, preferably no more than about 4 molar equivalents of dopant per molar equivalent of 3,4-ethylenedioxythiophene monomer, and more preferably no more than about 3 molar equivalents of dopant per molar equivalent of 3,4-ethylenedioxythiophene monomer, although the amount can be outside of these ranges.

Examples of suitable dopants include those with p-toluene sulfonate anions, such as p-toluene sulfonic acid, those with camphor sulfonate anions, such as camphor sulfonic acid, those with dodecyl sulfonate anions, such as dodecane sulfonic acid and sodium dodecyl sulfonate, those with benzene sulfonate anions, such as benzene sulfonic acid, those with naphthalene sulfonate anions, such as naphthalene sulfonic acid, those with dodecylbenzene sulfonate anions, such as dodecylbenzene sulfonic acid and sodium dodecylbenzene sulfonate, dialkyl benzenealkyl sulfonates, those with 1,3-benzene disulfonate anions, such as 1,3-benzene disulfonic acid sodium salt, those with para-ethylbenzene sulfonate anions, such as para-ethylbenzene sulfonic acid sodium salt, and the like, those with alkyl naphthalene sulfonate anions, such as sodium alkyl naphthalene sulfonates, including those with 1,5-naphthalene disulfonate anions, such as 1,5-naphthalene disulfonic acid sodium salt, and those with 2-naphthalene disulfonate anions, such as 2-naphtholene disulfonic acid, and the like, those with poly(styrene sulfonate) anions, such as poly (styrene sulfonate sodium salt), and the like.

Still another method of doping the poly(3,4-ethylenedioxythiophene) is to expose the toner particles that have the poly(3,4-ethylenedioxythiophene) on the particle surfaces to iodline vapor in solution, as disclosed in, for example, Yamamoto, T.; Morita, A.; Miyazaki, Y.; Maruyama, T.; Wakayama, H.; Zhou, Z. H.; Nakamura, Y.; Kanbara, T.; Sasaki, S.; Kubota, K.; *Macromolecules,* 1992, 25, 1214 and Yamamoto, T.; Abla, M.; Shimizu, T.; Komarudin, D.; Lee, B-L., Kurokawa, E. *Polymer Bulletin*, 1999, 42, 321, the disclosures of each of which are totally incorporated herein by reference.

The poly(3,4-ethylenedioxythiophene) thickness on the toner particles is a function of the surface area exposed for surface treatment, which is related to toner particle size and particle morphology, spherical vs potato or raspberry. For smaller particles the weight fraction of 3,4-ethylenedioxythiophene monomer used based on total mass of particles can be increased to, for example, 20 percent from 10 or 5 percent. The coating weight typically is at least about 5 weight percent of the toner particle mass, and typically is no more than about 20 weight percent of the toner particle mass. Similar amounts are used when the poly(3,4-ethylenedioxythiophene) is present throughout the particle instead of as a coating. The solids loading of the washed toner particles can be measured using a heated balance which evaporates off the water, and, based on the initial mass and the mass of the dried material, the solids loading can be calculated. Once the solids loading is determined, the toner slurry is diluted to a 10 percent loading of toner in water. For example, for 20 grams of toner particles the total mass of toner slurry is 200 grams and 2 grams of 3,4-ethylenedioxythiophene is used. Then the 3,4-ethylenedioxythiophene and other reagents are added as indicated hereinabove. For a 5 micron toner particle using a 10 weight percent of 3,4-ethylenedioxythiophene, 2 grams for 20 grams of toner particles the thickness of the conductive polymer shell was 20 nanometers. Depending on the surface morphology, which also can change the surface area, the shell can be thicker or thinner or even incomplete.

Unlike most other conductive polymer films, which typically are opaque and/or blue-black, the coatings of poly(3,4-ethylenedioxythiophene) in its oxidized form on the toner particles of the present invention are nearly non-colored and transparent, and can be coated onto toner particles of a wide variety of colors without impairing toner color quality. In addition, the use of a conductive polymeric coating on the toner particle to impart conductivity thereto is believed to be superior to other methods of imparting conductivity, such as blending with conductive surface additives, which can result in disadvantages such as reduced toner transparency, impaired gloss features, and impaired fusing performance.

The toners of the present invention typically exhibit interparticle cohesive forces of no more than about 20 percent, and preferably of no more than about 10 percent, although the interparticle cohesive forces can be outside of this range. There is no lower limit on interparticle cohesive forces; ideally this value is 0.

The toners of the present invention typically are capable of exhibiting triboelectric surface charging of from about + or −2 to about + or −60 microcoulombs per gram, and preferably of from about + or −10 to about + or −50 microcoulombs per gram, although the triboelectric charging capability can be outside of these ranges. Charging can be accomplished triboelectrically, either against a carrier in a two component development system, or in a single component development system, or inductively.

The polarity to which the toner particles of the present invention can be charged can be determined by the choice of oxidant used during the oxidative polymerization of the 3,4-ethylenedioxythiophene monomer. For example, using oxidants such as ammonium persulfate and potassium persulfate for the oxidative polymerization of the 3,4-ethylenedioxythiophene monomer tends to result in formation of toner particles that become negatively charged when subjected to triboelectric or inductive charging processes. Using oxidants such as ferric chloride and tris(p-toluenesulfonato)iron (III) for the oxidative polymerization of the 3,4-ethylenedioxythiophene monomer tends to result in formation of toner particles that become positively charged when subjected to triboelectric or inductive charging processes. Accordingly, toner particles can be obtained with the desired charge polarity without the need to change the toner resin composition, and can be achieved independently of any dopant used with the poly(3,4-ethylenedioxythiophene).

Specific embodiments of the invention will now be described in detail. These examples are intended to be illustrative, and the invention is not limited to the materials, conditions, or process parameters set forth in these embodiments. All parts and percentages are by weight unless otherwise indicated.

The particle flow values of the toner particles were measured with a Hosokawa Micron Powder tester by applying a 1 millimeter vibration for 90 seconds to 2 grams of the toner particles on a set of stacked screens. The top screen contained 150 micron openings, the middle screen contained 75 micron openings, and the bottom screen contained 45 micron openings. The percent cohesion is calculated as follows:

$$\% \text{ cohesion}=50\cdot A+30\cdot B+10\cdot C$$

wherein A is the mass of toner remaining on the 150 micron screen, B is the mass of toner remaining on the 75 micron screen, and C is the mass of toner remaining on the 45 micron screen. (The equation applies a weighting factor proportional to screen size.) This test method is further described in, for example, R. Veregin and R. Bartha, Proceedings of IS&T 14th International Congress on Advances in Non-Impact Printing Technologies, pg 358–361, 1998, Toronto, the disclosure of which is totally incorporated herein by reference. For the toners, the input energy applied to the apparatus of 300 millivolts was decreased to 50 millivolts to increase the sensitivity of the test. The lower the percent cohesion value, the better the toner flowability.

Conductivity values of the toners were determined by preparing pellets of each material under 1,000 to 3,000 pounds per square inch and then applying 10 DC volts across the pellet. The value of the current flowing was then recorded, the pellet was removed and its thickness measured, and the bulk conductivity for the pellet was calculated in Siemens per centimeter.

EXAMPLE I

Toner particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (NEOGEN RK; contained 60 percent active component), 3.66 kilograms of a nonophenol ethoxy nonionic surfactant (ANTAROX CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 30,600 and a number average molecular weight of 4,400 as determined with a Waters gel permeation chromatograph. The particle size of the latex as measured on a Disc Centrifuge was 278 nanometers.

375 grams of the styrene/n-butyl acrylate/acrylic acid anionic latex thus prepared was then diluted with 761.43 grams of deionized water. The diluted latex solution was blended with an acidic solution of the flocculant, 3.35 grams of poly(aluminum chloride) in 7.86 grams of 1 molar nitric acid solution, using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 50° C., at which point the average particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the toner particles was 5.4 microns and the particle size distribution was 1.26. A total of 5 washes were performed before the particle surface was treated by the in situ polymerization of the conductive polymer.

Into a 250 milliliter beaker was added 120 grams of the pigmentless toner size particle slurry (average particle diameter 5.4 microns; particle size distribution GSD 1.26) thus prepared, providing a total of 19.8 grams of solid material in the solution. The solution was then further diluted with deionized water to create a 200 gram particle slurry. Into this stirred solution was dissolved the oxidant ammonium persulfate (8.04 grams; 0.03525 mole). After 15 minutes, 2 grams (0.0141 mole) of 3,4-ethylenedioxythiophene monomer (EDOT) diluted in 5 milliliters of acetonitrile was added to the solution. The molar ratio of oxidant to EDOT was 2.5:1, and EDOT was present in an amount of 10 percent by weight of the toner particles. The reaction was stirred for 15 minutes, followed by the addition of 2 grams of the external dopant para-toluene sulfonic acid (p-TSA) dissolved in 10 milliliters of water. The solution was stirred overnight at room temperature. The resulting blue-green toner particles (with the slight coloration being the result of the poly(3,4-ethylenedioxythiophene) (PEDOT) particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=1.10\times10^{-7}$ Siemens per centimeter. The conductivity was determined by preparing a pressed pellet of the material under 1,000 to 3,000 pounds per square inch of pressure and then applying 10 DC volts across the pellet. The value of the current flowing through the pellet was recorded, the pellet was removed and its thickness measured, and the bulk conductivity for the pellet was calculated in Siemens per centimeter.

The conductive toner particles were charged by blending 24 grams of carrier particles (65 micron Hoeganes core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of 5.5 microCoulombs per gram. The flow properties of this toner were measured with a Hosakawa powder flow tester to be 4.5 percent cohesion. Scanning electron micrographs (SEM) of the treated particles indicated that a surface coating was indeed on the surface, and transmission electron micrographs indicated that the surface layer of PEDOT was 20 nanometers thick.

COMPARATIVE EXAMPLE A

For comparative purposes, the average bulk conductivity of a pressed pellet of the pigmentless toner particles provided in the first slurry in Example I prior to reaction with the other ingredients was measured at $7.2\times10^{-15}$ Siemens per centimeter. The conductive toner particles were charged by blending 24 grams of carrier particles (65 micron Hoeg änes core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of 0.51 microCoulombs per gram. The flow properties of this toner were measured with a Hosakawa powder flow tester to be 21.4 percent cohesion.

COMPARATIVE EXAMPLE B

For comparative purposes, 150 gram portions of a pigmentless toner particle slurry consisting of 11.25 grams of solid toner particles prepared as described in Example I were added into five separate 250 milliliter beakers. These experiments were performed to determine if oxidative polymerization of the monomer occurred in the absence of an oxidant such as ammonium persulfate. After measuring the pH of the pigmentless toner slurry (pH=6.0), to the first container was slowly added 0.45 grams of 3,4-ethylenedioxythiophene (EDOT) monomer (4 percent by weight of particles) obtained from Bayer and let stir overnight. After the particles were washed by filtration and resuspending in deionized water 6 times, they were dried by freeze drying. The average particle size was 5.1 microns with a particle size distribution of 1.22. The bulk conductivity of a pressed pellet of this sample was measured to be $3.0\times10^{-15}$ Siemens per centimeter, indicating that insufficient or no polymerization of the EDOT onto the particle surfaces occurred.

To the second beaker was added dropwise 2 Normal sulfuric acid to a pH level of 2.7. To this acidified solution was then added 0.45 grams of 3,4-ethylenedioxythiophene (EDOT) monomer (4 percent by weight of particles) (obtained from Bayer) and allowed to stir overnight. The white particles slurry had turned to a bluey-green solution. After the particles were washed by filtration and resuspended in deionized water 6 times, they were dried by freeze drying. The average particle size was 5.2 microns with a particle size distribution of 1.23. The bulk conductivity of a pressed pellet of this sample was measured to be $4.7\times10^{-15}$ Siemens per centimeters, indicating that insufficient or no polymerization of the EDOT onto the particle surfaces occurred.

To the third beaker was added 1.125 grams of poly(3,4-ethylenedioxythiophene), PEDOT polymer (10 percent by weight of particles) (obtained from Bayer) and allowed to stir overnight. After the particles were washed by filtration and resuspended in deionized water 6 times, they were dried by freeze drying. The average particle size was 5.1 microns with a particle size distribution of 1.22. The bulk conductivity of a pressed pellet of this sample was measured to be $7.4\times10^{15}$ Siemens per centimeter, indicating that insufficient or no deposition of the PEDOT onto the particle surfaces occurred.

To the fourth beaker was added 1.125 grams of 3,4-ethylenedioxythiophene (EDOT) monomer (10 percent by weight of particles) (obtained from Bayer) and allowed to stir overnight. The solution was clear and colorless with no visible indication of oxidative polymerization. After the particles were washed by filtration and resuspended in deionized water 6 times, they were dried by freeze drying. The average particle size was 5.2 microns with particle size distribution of 1.23. The bulk conductivity of a pressed pellet of this sample was measured to be $1.0\times10^{-14}$ Siemens per centimeters, indicating that insufficient or no polymerization of the EDOT onto the particle surfaces occurred.

To the fifth beaker was added the dopant para-toluene sulfonic acid (p-TSA) to pH=2.7. Thereafter, 0.45 gram of 3,4-ethylenedioxythiophene (EDOT) monomer (4 percent by weight of particles) (obtained from Bayer) was added and allowed to stir overnight. The supernatant was bluey-green after 24 hours. After the particles were washed by filtration and resuspending in deionized water 6 times, they were dried by freeze drying. The average particle size was 5.6 microns with a particle size distribution of 1.24. The bulk conductivity of a pressed pellet of this sample was measured to be $9.9\times10^{-15}$ Siemens per centimeters, indicating that insufficient or no polymerization of the EDOT onto the particle surfaces occurred.

EXAMPLE II

Toner particles were prepared by aggregation of a styrene/n-butyl acrylate/acrylic acid latex using a flocculate poly (aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (NEOGEN RK; contained 60 percent active component), 3.66 kilograms of a nonophenol ethoxy nonionic surfactant (ANTAROX CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 30,600 and a number average molecular weight of 4,400 as determined with a Waters gel permeation chromatograph. The particle size of the latex as measured on a Disc Centrifuge was 278 nanometers.

375 grams of the styrene/n-butyl acrylate/acrylic acid anionic latex thus prepared was then diluted with 761.43 grams of deionized water. The diluted latex solution was blended with an acidic solution of the flocculant, 3.345 grams of poly(aluminum chloride) in 7.186 grams of 1 molar nitric acid solution, using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 53° C., at which point the average particle size was 5.2 microns and the particle size distribution was 1.20. At this point the pH of the solution was adjusted to 7.2 using 4 percent sodium hydroxide solution. The mixture was then heated at a controlled rate of0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the toner particles was 5.6 microns and the particle size distribution was 1.24. A total of 5 washes were performed before the particle surface was treated by the in situ polymerization of the conductive polymer.

Into a 250 milliliter beaker was added 150 grams of the pigmentless toner size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.24. Into this stirred solution was added 3.35 grams (0.0176 mole) of the dopant para-toluene sulfonic acid (p-TSA), and the pH was then measured as 1.22. After 15 minutes, 2.5 grams (0.0176 mole) of 3,4-ethylenedioxythiophene monomer (EDOT) was added to the solution. The molar ratio of dopant to EDOT was 1:1, and EDOT was present in an amount of 10 percent by weight of the toner particles. After 2 hours, the dissolved oxidant ammonium persulfate (4.02 grams (0.0176 mole) in 10 milliliters of deionized water) was added dropwise over a 10 minute period. The molar ratio of oxidant to EDOT was 1:1. The solution was then stirred overnight at room temperature and thereafter allowed to stand for 3 days. The resulting bluish toner particles (with the slight coloration being the result of the PEDOT particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=3.9\times10^{-3}$ Siemens per centimeter. The bulk conductivity was remeasured one week later and found to be $\sigma=4.5\times10^{-3}$ Siemens per centimeter. This remeasurement was performed to determine if the conductivity level was stable over time.

EXAMPLE III

Toner particles were prepared as described in Example II. Into a 250 milliliter beaker was added 150 grams of the pigmentless toner size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.02. Into this stirred solution was added 8.37 grams (0.0440 mole) of the dopant para-toluene sulfonic acid (p-TSA) and the pH was measured as 0.87. After 15 minutes, 2.5 grams (0.0176 mole) of 3,4-ethylenedioxythiophene monomer (EDOT) was added to the solution. The molar ratio of dopant to EDOT was 2.5:1, and EDOT was present in an amount of 10 percent by weight of the toner particles. After 2 hours, the dissolved oxidant (ammonium persulfate 5.02 grams (0.0219 mole) in 10 milliliters of deionized water) was added dropwise over a 10 minute period. The molar ratio of oxidant to EDOT was 1.25:1. The solution was stirred overnight at room temperature and then allowed to stand for 3 days. The resulting bluish toner particles (with the slight coloration being the result of the PEDOT particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=4.9\times10^{-3}$ Siemens per centimeter. The bulk conductivity was remeasured one week later and found to be $\sigma=3.7\times10^{-3}$ Siemens per centimeter. This remeasurement was done to determine if the conductivity level was stable over time.

EXAMPLE IV

Cyan toner particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (NEOGEN RK; contained 60 percent active component), 3.66 kilograms of a nonophenol ethoxy nonionic surfactant (ANTAROX CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

The cyan toner particles were prepared using the latex thus prepared, wherein the toner particles consisted of 70 percent by weight of the latex mixed with pigment to prepare the particle cores and 30 percent by weight of the same latex used to form shells around the pigmented cores. Into a 2 liter glass reaction kettle was added 249.4 grams of the styrene/n-butyl acrylate/acrylic acid anionic latex thus prepared and diluted with 646.05 grams of deionized water. To the diluted latex solution was added 14.6 grams of BHD 6000 pigment dispersion (obtained from Sun Chemical, containing 51.4 percent by weight solids of pigment blue cyan 15:3) dispersed into sodium dodecyl benzene sulfonate anionic surfactant (NEOGEN R) solution. The pigmented latex solution was blended with an acidic solution of the flocculant (3.2 grams of poly(aluminum chloride) in 7.5 grams of 1 molar nitric acid solution) using a high shear homogenizer at 4,000 to 5,000 revolutions per minute for 2 minutes, producing a flocculation or heterocoagulation of gelled particles consisting of nanometer sized pigmented latex particles. The slurry was heated at a controlled rate of 0.25° C. per minute to 50° C., at which point the average particle size was 4.75 microns and the particle size distribution was 1.20. At this point, 106.98 grams of the above latex was added to aggregate around the already toner sized pigmented cores to form polymeric shells. After an additional 2 hours at 50° C., the aggregated particles had an average particle size of 5.55 microns and a particle size distribution of 1.33. At this point, the pH of the solution was adjusted to 8.0 using 4 percent sodium hydroxide solution. The mixture was then heated at a controlled rate of 0.5° C. per minute to 96° C. After the particle slurry had maintained the reaction temperature of 96° C. for 1 hour, the pH was dropped to 5.5 using 1 molar nitric acid, followed by maintenance of this temperature for 6 hours. After cooling the reaction mixture to room temperature, the particles were washed and reslurried in deionized water. The average particle size of the toner particles was 5.6 microns and the particle size distribution was 1.24. A total of 5 washes were performed before the particle surface was treated by the in situ polymerization of the conductive polymer.

Into a 250 milliliter beaker was added 150 grams of the cyan toner size particle slurry (average particle diameter 5.6 microns: particle size distribution GSD 1.24) thus prepared, providing a total of 18.7 grams of solid material in the solution. The solution was then further diluted with deionized water to create a 200 gram particle slurry. Into this stirred solution was added 1.25 grams (0.00658 mole) of the dopant para-toluene sulfonic acid (p-TSA) and the pH was measured as 2.4. After 15 minutes, 1.87 grams (0.0132 mole) of 3,4-ethylenedioxythiophene monomer (EDOT) diluted in 2 milliliters of acetonitrile was added to the solution. The molar ratio of dopant to EDOT was 0.5:1, and EDOT was present in an amount of 10 percent by weight of the toner particles. After 1 hour, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish toner particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.499\times10^{-2}$ Siemens per centimeter. The chemical oxidative polymerization of EDOT to produce PEDOT occurred on the toner particle surface, and the particle surfaces were rendered semi-conductive by the presence of the sulfonate groups from the toner particle surfaces and by the added p-TSA. The measured average bulk conductivity of a pressed pellet of this toner was $\sigma-1.9\times10^{-9}$ Siemens per centimeter.

EXAMPLE V

Cyan toner particles were prepared as described in Example IV. Into a 250 milliliter beaker was added 150 grams of the cyan toner size particle slurry (average particle diameter 5.6 microns; particle size distribution GSD 1.24) thus prepared, providing a total of 18:7 grams of solid material in the solution. The solution was then further diluted with deionized water to create a 200 gram particle slurry. Into this stirred solution was added 2.51 grams (0.0132 mole) of the dopant para-toluene sulfonic acid (p-TSA) and the pH was measured as 0.87. After 15 minutes, 1.87 grams (0.0132 mole) of 3,4-ethylenedioxythiophene monomer (EDOT) was added to the solution. The molar ratio of dopant to EDOT was 1:1, and EDOT was present in an amount of 10 percent by weight of the toner particles. After 2 hours, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish toner particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.967\times10^{-2}$ Siemens per centimeter. The chemical oxidative polymerization of EDOT to produce PEDOT occurred on the toner particle surface, and the particle surfaces were rendered semi-conductive by the presence of the sulfonate groups from the toner particle surfaces and by the added p-TSA. The measured average bulk conductivity of a pressed pellet of this toner was $\sigma=1.3\times10^{-7}$ Siemens per centimeter.

EXAMPLE VI

Unpigmented toner particles were prepared by aggregation of a styrene/n-butyl acrylate/acrylic acid latex using a flocculent (poly(aluminum chloride)) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows; 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water in which had been dissolved 7.67 kilograms of sodium dodecyl benzene sulfonate anionic surfactant (NEOGEN RK; contains 60 percent active component), 3.66 kilograms of a nonophenol ethoxy nonionic surfactant (ANTAROX CA-897, 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DUPONT DSC. The latex had a weight average molecular weight of 30,600 and a number average molecular weight of 4,400 as determined with a Waters gel permeation chromatograph. The particle size of the latex as measured on a Disc Centrifuge was 278 nanometers.

Thereafter, 375 grams of the styrene/n-butyl acrylate/acrylic acid anionic latex thus prepared was diluted with 761.43 grams of deionized water. The diluted latex solution was blended with an acidic solution of the flocculent (3.35 grams of poly(aluminum chloride) in 7.86 grams of 1 molar nitric acid solution) using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 50° C., at which point the average particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted at the reaction temperature of 95° C., the pH was dropped to 5.0 using 1 molar nitric acid, followed by maintenance of this temperature for 6 hours. The particles were then cooled to room temperature. From this toner slurry 150 grams was removed and washed 6 times by filtration and resuspension in deionized water. The particles were then dried with a freeze dryer for 48 hours. The average particle size of the toner particles was 5.7 microns and the particle size distribution was 1.24.

Into a 250 milliliter beaker was added 150 grams of the pigmentless toner size particle slurry thus prepared providing a total of 11.25 grams of solid material in the solution. The pH of the solution was then adjusted by adding the dopant, para-toluene sulfonic acid (PTSA) until the pH was 2.73. Into this stirred solution was dissolved the oxidant ammonium persulfate (1.81 grams; 7.93 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surface, and the particle surfaces were rendered slightly conductive by the presence of the sulfonate groups from the toner particle surfaces and by the added pTSA. The average particle size of the toner particles was 5.1 microns and the particle size distribution was 1.24. The bulk conductivity of this sample when pressed into a pellet was $3.1\times10^{-13}$ Siemens per centimeter. The conductive toner particles were charged by blending 24 grams of carrier particles (65 micron Hoegänes core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of −36.3 microCoulombs per gram.

EXAMPLE VII

Unpigmented toner particles were prepared by the method described in Example VI. Into a 250 milliliter beaker was added 150 grams of a pigmentless toner size particle slurry (average particle diameter 5.7 microns; particle size distribution GSD 1.24) providing a total of 20.0 grams of solid material in the solution. The pH of the solution was not adjusted before the oxidant was added. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) was added to the solution. The molar ratio of oxidant to EDOT was 1.1:1, and EDOT was present in an amount of 10 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner a particle surfaces, and the particle surfaces were rendered slightly conductive by the presence of the sulfonate groups from the toner particle surfaces. The average particle size of the toner particles was 5.2 microns and the particle size distribution was 1.23. The bulk conductivity of this sample when pressed into a pellet was $3.8\times10^{-13}$ Siemens per centimeter. The triboelectric charge measured by the method and with the carrier described in Example VI was −8.8 microCoulombs per gram.

EXAMPLE VIII

Toner particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of ideionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DUPONT DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) diluted in 5 milliliters of acetonitrile was added to the solution. The molar ratio of oxidant to EDOT was 1.1:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $1.3\times10^{-7}$ Siemens per centimeter. The triboelectric charge measured by the method and with the carrier described in Example VI was −3.6 microCoulombs per gram.

EXAMPLE IX

Unpigmented toner particles were prepared by the method described in Example VI. Into a 250 milliliter beaker was added 150 grams of a pigmentless toner size particle slurry (average particle diameter 5.7 microns; particle size distribution GSD 1.24) providing a total of 11.25 grams of solid material in the solution. The pH of the solution was then adjusted by adding the dopant para-toluene sulfonic acid (PTSA) until the pH was 2.73. Into this stirred solution was dissolved the oxidant ferric chloride (1.3 grams; 8.0 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surfaces, and the particle surfaces were rendered slightly conductive by the presence of the sulfonate groups from the toner particle surfaces and by the added pTSA. The average particle size of the toner particles was 5.1 microns and the particle size distribution was 1.22. The bulk conductivity of this sample when pressed into a pellet was $1.7\times10^{-13}$ Siemens per centimeter. The triboelectric charge measured by the method and with the carrier described in Example VI was +15.8 microCoulombs per gram.

EXAMPLE X

Toner particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DUPONT DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (5.7 grams; 0.0352 mole). After 30 minutes, 2.0 grams (0.0141 mole) of 3,4-ethylenedioxythiophene monomer (EDOT) was added to the solution. The molar ratio of oxidant to EDOT was 2.5:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $3.5\times10^{-9}$ Siemens per centimeter. The triboelectric charge measured by the method and with the carrier described in Example VI was +4.1 microCoulombs per gram.

EXAMPLE XI

Toner particles were prepared by aggregation of a styrene/n-butyl acrylate/styrene sulfonate sodium salt/acrylic acid latex using a flocculent (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 ports by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DUPONT DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (1.15 grams; 7.09 mmole). After 15 minutes, 2.0 grams (0.0141 mole) of 3,4-ethylenedioxythiophene monomer (EDOT) was added to the solution. The molar ratio of oxidant to EDOT was 0.5:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $1.5\times10^{-7}$ Siemens per centimeter. The triboelectric charge measured by the method and with the carrier described in Example VI was +7.1 microCoulombs per gram.

EXAMPLE XII

Toner compositions are prepared as described in Examples I through XI except that no dopant is employed. It is believed that the resulting toner particles will be relatively insulative and suitable for two-component development processes.

EXAMPLE XIII

Toners are prepared as described in Examples VI, VII, IX, and XII. The toners thus prepared are each admixed with a carrier as described in Example VI to form developer compositions. The developers thus prepared are each incorporated into an electrophotographic imaging apparatus. In each instance, an electrostatic latent image is generated on the photoreceptor and developed with the developer. Thereafter the developed images are transferred to paper substrates and affixed thereto by heat and pressure.

EXAMPLE XIV

A toner was prepared as described in Example III. The toner was evaluated for nonmagnetic inductive charging by placing the toner on a conductive (aluminum) grounded substrate and touching the toner with a 25 micron thick MYLAR® covered electrode held at a bias of +100 volts. Upon separation of the MYLAR® covered electrode from the toner, a monolayer of toner was adhered to the MYLAR®. The electrostatic surface potential of the induction charged monolayer was approximately −100 volts. The fact that the electrostatic surface potential is equal and opposite to the bias applied to the MYLAR® electrode indicates that the toner is sufficiently conducting to enable induction toner charging. The powder conductivity was measured to be $2.5\times10^{-5}$ Siemens per centimeter. This measured conductivity for the toner is consistent with the observed induction charging properties. The powder is more conductive than commercially available magnetic, conductive toner used in conventional single component development systems.

EXAMPLE XV

Toners are prepared as described in Examples I to V, VIII, X and XI. The toners thus prepared are each tested by the method described in Example XIV. It is believed that these materials will also be indicated to be nonmagnetically inductively chargeable.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A toner comprising particles of a vinyl resin, an optional colorant, and poly(3,4-ethylenedioxythiophene), wherein said toner particles ore prepared by an emulsion aggregation process, wherein the poly(3,4-ethylenedioxythiophene) is doped with a dopant present in on amount of at least about 0.1 molar equivalent of dopant per molar equivalent of 3,4-ethylenedioxythiophene monomer and present in an amount of no more than about 5 molar equivalents of dopant per molar equivalent of 3,4-ethylenedioxythiophene monomer.

2. A toner according to claim 1 wherein the toner particles have an average particle diameter of no more than about 13 microns.

3. A toner according to claim 1 wherein the toner particles comprise a core comprising the vinyl resin and optional colorant and, coated on the core, a coating comprising the poly(3,4-ethylenedioxythiophene).

4. A toner according to claim 1 wherein the vinyl resin is a polymer of monomers selected from styrenes, acrylates, methacrylates, vinyl acrylic acids, butodiene, isoprene, or mixtures thereof.

5. A toner according to claim 1 wherein the vinyl resin is a polymer of monomers selected from styrene, p-methyl styrene, m-methyl styrene, α-methyl styrene, methyl acrylate, ethyl acrylate, propyl acrylate, butyl acrylate, β-carboxyethyl acrylate, methyl methacrylate, ethyl methacrylate, propyl methacrylate, butyl methacrylate, acrylic acid, methacrylic acid, butadiene, Isoprene,. styrene sulfonic acid and salts thereof, 4-vinylbenzene sulfonic acid and salts thereof, vinylsulfonic acid and salts thereof, 2-acrylamldo-N-methylpropone sulfonic acid and salts thereof; vinyl-1-pyridinium propane sulfonate and salts thereof, or mixtures thereof.

6. A toner according to claim 1 wherein the vinyl resin is poly(styrene/butodiene), poly(p-methylstyrene/butadiene), poly(m-methyl styrene/butadiene), poly(α-methyl styrene/butadiene), poly(methyl methacrylate/butadiene), poly(ethyl methacrylate/butadiene), polypropyl methacrylate/butadiene), poly(butyl methacrylate/butadiene), poly (methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly (ethyl methacrylate/isoprene), poly(propyl methacrylate/isoprene), poly(butyl methacrylate/isoprene), poly(methyl acrylate/isoprene), poly(ethyl acrylate/isoprene), poly (propyl acrylate/isoprene), poly(butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), poly(styrene/n-butyl acrylate/styrene sulfonate sodium salt/acrylic acid), or mixtures thereof.

7. A toner according to claim 1 wherein the resin is present in the toner particles in an amount of at least about 75 percent by weight of the toner particles and wherein the resin is present in the toner particles in an amount of no more than about 99 percent by weight of the toner particles.

8. A toner according to claim 1 wherein the toner particles further comprise a pigment colorant.

9. A toner according to claim 1 wherein the toner particles contain a colorant said colorant being present in on amount of at least about 1 percent by weight of the toner particles, and said colorant being present in an amount of no more than about 25 percent by weight of the toner particles.

10. A toner according to claim 1 wherein the emulsion aggregation process comprises (1) shearing a first: ionic surfactant with a latex mixture comprising (a) a counterionic surfactant with a charge polarity of opposite sign to that of said first ionic surfactant, (b) a nonionic surfactant, and (c) the vinyl resin, thereby causing flocculation or heterocoagulation of formed particles of resin to form electrostatically bound aggregates; and (2) heating the electrostatically bound aggregates to form aggregates of at least about 1 micron in average particle diameter.

11. A toner according to claim 1 wherein the emulsion aggregation process comprises (1) preparing a colorant dispersion in a solvent which dispersion comprises a colorant and a first ionic surfactant; (2) shearing the colorant dispersion with a latex mixture comprising (a) a counterionic surfactant with a charge polarity of opposite sign to that of said first ionic surfactant, (b) a nonionic surfactant, and (c) the vinyl resin, thereby causing flocculation or heterocoagulation of formed particles of colorant and resin to form electrostatically bound aggregates; and (3) heating the electrostatically bound aggregates to form aggregates of at least about 1 micron in average particle diameter.

12. A toner according to claim 1 wherein the emulsion aggregation process comprises (1) shearing an ionic surfactant with a latex mixture comprising (a) a flocculating agent, (b) a nonionic surfactant, and (c) the vinyl resin, thereby causing flocculation or heterocoagulation of formed particles of resin to form electrostatically bound aggregates, and (2) heating the electrostatically bound aggregates to form aggregates of at least about 1 micron in average particle diameter.

13. A toner according to claim 1 wherein and the emulsion aggregation process comprises (1) preparing a colorant dispersion in a solvent, which dispersion comprises a colorant and an ionic surfactant, (2) shearing the colorant dispersion with a latex mixture comprising (a) a flocculating agent, (b) a nonionic surfactant, and (c) the vinyl resin, thereby causing flocculation or heterocoagulation of formed particles of colorant and resin to form electrostatically bound aggregates; and (3) heating the electrostatically bound aggregates to form aggregates of at least about 1 micron in average particle diameter.

14. A toner according to claim 1 wherein the poly(3,4-ethylenedioxythiophene) is formed from monomers of the formula

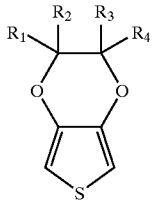

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group.

15. A toner according to claim 14 wherein $R_1$ and $R_3$ are hydrogen atoms and $R_2$ and $R_4$ are (a) $R_2$=H, $R_4$=H; (b) $R_2=(CH_2)_nCH_3$ wherein n=0–14. $R_4$=H; (c) $R_2=(CH_2)_nCH_3$ wherein n=0–14, $R_4=(CH_2)_nCH_3$ wherein n=0–14; (d) $R_2=(CH_2)_nSO_3{-}Na^+$ wherein n=1–6, $R_4$=H; (e) $R_2=(CH_2)_nSO_3{-}Na^+$ wherein n=1–6, $R_4=(CH_2)_nSO_3{-}Na^+$ wherein n=1–6; (f) $R_2=(CH_2)_nOR_6$ wherein n=0–4 and $R_6$=(i) H or (ii) $(CH_2)_mCH_3$ wherein m=0–4, $R_4$=H; or (g) $R_2=(CH_2)_nOR_6$ wherein n=0–4 and $R_6$=(i) H or (ii) $(CH_2)_mCH_3$wherein m=0–4, $R_4=(CH_2)_nOR_6$ wherein n=0–4 and $R_6$=(i) H or (ii) $(CH_2)_mCH_3$ wherein m=0–4.

16. A toner according to claim 1 wherein the poly(3,4-ethylenedioxythiophene) is of the formula

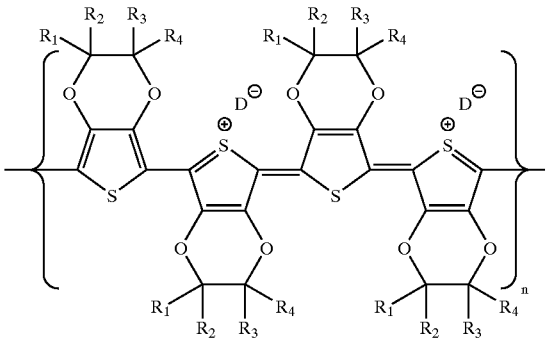

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group, D– is a dopant moiety, and n is an integer representing the number of repeat monomer units.

17. A toner according to claim 1 wherein the poly(3,4-ethylenedioxythiophene) has at least about 3 repeat monomer units.

18. A toner according to claim 1 wherein the poly(3,4-ethylenedioxythiophene) is doped with iodine, molecules containing sulfonate groups, molecules containing phosphate groups, molecules containing phosphonate groups, or mixtures thereof.

19. A toner according to claim 1 wherein the poly(3,4-ethylenedioxythiophene) is doped with sulfonate containing anions of the formula $RSO_3$— wherein R is an alkyl group, an alkoxy group, an aryl group, an aryloxy group, an arylalkyl group, an alkylaryl group, an arylalkyloxy group, an alkylaryloxy group, or mixtures thereof.

20. A toner according to claim 1 wherein the poly(3,4-ethylenedioxythiophene) is doped with anions selected from p-toluene sulfonate, camphor sulfonate, benzene sulfonate, naphtholene sulfonate, dodecyl sulfonate, dodecylbenzene sulfonate, dialkyl benzenealkyl sulfonates, para-ethylbenzene sulfonate, alkyl naphthalene sulfonates, poly (styrene sulfonate), or mixtures thereof.

21. A toner according to claim 1 wherein the poly(3,4-ethylenedioxythiophene) is doped with onions selected from p-toluene sulfonate, camphor sulfonate, benzene sulfonate, naphthalene sulfonate, dodecyl sulfonate, dodecylbenzene sulfonate. 1,3-benzene disulfonate, para-ethylbenzene sulfonate, 1,5-naphthalene disulfonate, 2-naphtholene disulfonate, poly(styrene sulfonate), or mixtures thereof.

22. A toner according to claim 1 wherein the poly(3,4-ethylenedioxythiophene) is doped with a dopant present in an amount of at least about 0.25 molar equivalent of dopant per molar equivalent of 3,4-ethylenedioxythiophene monomer and present in an amount of no more than about 4 molar equivalents of dopant per molar equivalent of 3,4-ethylenedioxythiophene monomer.

23. A toner according to claim 1 wherein the poly(3,4-ethylenedioxythiophene) is doped with a dopant present in an amount of at least about 0.5 molar equivalent of dopant per molar equivalent of 3,4-ethylenedioxythiophene monomer and present in an amount of no more than about 3 molar equivalents of dopant per molar equivalent of 3,4-ethylenedioxythiophene monomer.

24. A toner according to claim 1 wherein the poly(3,4-ethylenedioxythiophene) is present in an amount of at least about 5 weight percent of the toner particle mass and wherein the poly(3,4-ethylenedioxythiophene) is present in an amount of no more than about 20 weight percent of the toner particle mass.

25. A toner according to claim 1 wherein the toner particles have an average particle diameter of no more than about 10 microns.

26. A toner according to claim 1 wherein the toner particles hove a particle size distribution of GSD equal to no more than about 1.25.

27. A toner according to claim 1 wherein the toner particles have an average bulk conductivity of no more than about $10^{-12}$ Siemens per centimeter.

28. A toner according to claim 1 wherein the toner particles have an average bulk conductivity of no less than about $10^{-11}$ Siemens per centimeter.

29. A toner according to claim 1 wherein the toner particles have an average bulk conductivity of no less than about $10^{-7}$ Siemens per centimeter.

30. A toner according to claim 1 wherein said toner particles are nonmagnetic.

31. A toner according to claim 1 wherein the toner particles have an average bulk conductivity of no more than about $10^{-13}$ Siemens per centimeter, and wherein the toner particles have an average bulk conductivity of no less than about $10^{-16}$ Siemens per centimeter.

32. A comprising particles of a vinyl resin, an optional colorant, and poly(3,4-ethylenedioxythiophene), wherein said toner particles are prepared by an emulsion aggregation process, wherein the toner particles comprise a core comprising the vinyl resin and optional colorant, said core having a surface, and, coated on the core, a coating comprising the poly(3,4-ethylenedioxythiophene), wherein the vinyl resin is a sulfonated vinyl resin, and wherein the sulfonated vinyl resin anchors the poly(3,4-ethylenedioxythiophene) to the core surface.

33. A toner comprising particles of a vinyl resin, an optional colorant, and poly(3,4-ethylenedioxythiophene), wherein said toner particles are prepared by an emulsion aggregation process, wherein the emulsion aggregation process comprises (1) shearing a first ionic surfactant with a latex mixture comprising (a) a counterionic surfactant with a charge polarity of opposite sign to that of said first ionic surfactant, (b) a nonionic surfactant, and (c) the vinyl resin, thereby causing flocculation or heterocoagulation of formed particles of resin to form electrostatically bound aggregates; and (2) heating the electrostatically bound aggregates to form aggregates of at least about 1 micron in average particle diameter, wherein the toner particles comprise a core comprising the vinyl resin and optional colorant, said core having a surface, and, coated on the core, a coating comprising the poly(3,4-ethylenedioxythiophene), wherein the ionic surfactant has a sulfonate group thereon, wherein the ionic surfactant remains on the core surface, and wherein the ionic surfactant acts as a dopant for the poly(3,4-ethylenedioxythiophene).

34. A toner comprising particles of a vinyl resin, a colorant, and poly(3,4-ethylenedioxythiophene), wherein said toner particles are prepared by an emulsion aggregation process, wherein the emulsion aggregation process comprises (1) preparing a colorant dispersion in a solvent, which dispersion comprises the colorant and a first ionic surfactant, (2) shearing the colorant dispersion with a latex mixture comprising (a) a counterionic surfactant with a charge polarity of opposite sign to that of said first ionic surfactant, (b) a nonionic surfactant, and (c) the vinyl resin, thereby causing flocculation or heterocoagulation of formed particles of colorant and resin to form electrostatically bound aggregates; and (3) heating the electrostatically bound aggregates to form aggregates of at least about 1 micron in average particle diameter wherein the toner particles comprise a core comprising the vinyl resin and colorant, said core having a surface, and, coated on the core, a coating comprising the poly(3,4-ethylenedioxythiophene), wherein one the ionic surfactant has a sulfonate group thereon, wherein the ionic surfactant remains on the core surface, and wherein ionic surfactant acts as a dopant for the poly(3,4-ethylenedioxythiophene).

35. A toner comprising particles of a vinyl resin, an optional colorant, and poly(3,4-ethylenedioxythiophene), wherein said toner particles are prepared by an emulsion aggregation process, wherein the emulsion aggregation process comprises (1) shearing an ionic surfactant with a latex mixture comprising (a) a flocculating agent, (b) a nonionic surfactant, and (c) the vinyl resin, thereby cousins flocculation or heterocoagulation of formed particles of resin to form electrostatically bound aggregates; and (2) heating the electrostatically bound aggregates to form aggregates of at least about 1 micron in average particle diameter, wherein the toner particles comprise a core comprising the vinyl resin and optional colorant, said core having a surface, and, coated on the core, a coating comprising the poly(3,4-ethylenedioxythiophene), wherein the ionic surfactant has a sulfonate group thereon, wherein the ionic surfactant remains on the core surface, and wherein the ionic surfactant acts as a dopant for the ploy(3,4-ethylenedioxythiophene).

36. A toner comprising particles of a vinyl resin, a colorant, and poly(3,4-ethylenedioxythiophene), wherein said toner particles are prepared by an emulsion aggregation process, wherein the emulsion aggregation process comprises (1) preparing a colorant dispersion in a solvent, which dispersion comprises the colorant and an ionic surfactant; (2) shearing the colorant dispersion with a latex mixture comprising (a) a flocculating agent (b) a nonionic surfactant, and (c) the vinyl resin, thereby causing flocculation or heterocoagulation of formed particles of colorant and resin to form electrostatically bound aggregates: and (3) heating the electrostatically bound aggregates to form aggregates of at least about 1 micron in average particle diameter, wherein the toner particles comprise a core comprising the vinyl resin and colorant, said core having a surface, and, coated on the core, a coating comprising the poly(3,4-ethylenedioxythiophene), wherein the ionic surfactant has a sulfonate group thereon, wherein the ionic surfactant remains on the core surface, and wherein the ionic surfactant acts as a dopant for the poly(3,4-ethylenedioxythiophene).

37. A toner comprising particles of a vinyl resin, an optional colorant, and poly(3,4-ethylenedioxythiophene), wherein said toner particles are prepared by an emulsion aggregation process, wherein the toner particles comprise a core comprising the vinyl resin and optional colorant and, coated on the core, a coating comprising the poly(3,4-ethylenedioxythiophene), wherein the vinyl resin is a sulfonated vinyl resin, and wherein the sulfonated vinyl resin acts as a dopant for the poly(3,4-ethylenedioxythiophene).

38. A toner according to claim 37 wherein the vinyl resin is a polymer of monomers selected from styrene sulfonic acid or salts thereof, 4-vinylbenzene sulfonic acid or salts thereof, vinylsulfonic acid or salts thereof, 2-acrylamido-N-methylpropane sulfonic acid or salts thereof, vinyl-1-pyridinium propane sulfonate or salts thereof, or mixtures thereof.

39. A toner comprising particles of a vinyl resin, an optional colorant, and poly(3,4-ethylenedioxythiophene), wherein sold toner particles are prepared by an emulsion aggregation process, wherein said poly(3,4-ethylenedioxythiophene) has no more than about 100 repeat monomer units, wherein the poly(3,4-ethylenedioxythiophene) is doped with a dopant present in an amount of at least about 0.1 molar equivalent of dopant per molar equivalent of 3,4-ethylenedioxythiophene monomer and present in an amount of no more than about 5 molar equivalents of dopant per molar equivalent of 3,4-ethylenedioxythiophene monomer, wherein said poly(3,4-ethylenedioxythiophene) has at least about 3 repeat monomer units.

40. A toner according to claim 39 wherein said poly(3,4-ethylenedioxythiophene) has at least about 6 repeat monomer units.

* * * * *